US012565790B2

(12) United States Patent
Walker et al.

(10) Patent No.: US 12,565,790 B2
(45) Date of Patent: Mar. 3, 2026

(54) MODULAR FENCING SYSTEM

(71) Applicant: Peak Innovations Inc., Richmond (CA)

(72) Inventors: Simon Walker, Delta (CA); Craig Lawson, Burnaby (CA)

(73) Assignee: PEAK INNOVATIONS INC., Richmond (CA)

( * ) Notice: Subject to any disclaimer, the term of this patent is extended or adjusted under 35 U.S.C. 154(b) by 460 days.

(21) Appl. No.: 18/011,144

(22) PCT Filed: Aug. 10, 2021

(86) PCT No.: PCT/CA2021/051106

§ 371 (c)(1),
(2) Date: Dec. 16, 2022

(87) PCT Pub. No.: WO2022/032383

PCT Pub. Date: Feb. 17, 2022

(65) Prior Publication Data

US 2023/0212875 A1 Jul. 6, 2023

Related U.S. Application Data

(60) Provisional application No. 63/181,547, filed on Apr. 29, 2021, provisional application No. 63/063,825, filed on Aug. 10, 2020.

(51) Int. Cl.
*E04H 17/16* (2006.01)

(52) U.S. Cl.
CPC ..... *E04H 17/168* (2013.01); *E04H 17/17* (2021.01)

(58) Field of Classification Search
CPC ... E04H 17/16; E04H 17/1602; E04H 17/165; E04H 17/166; E04H 17/168; E04H 17/17; E04F 11/1851; E04F 2011/1823; E04F 2011/1825; E04F 2011/1831
See application file for complete search history.

(56) References Cited

U.S. PATENT DOCUMENTS 5,702,090 A * 12/1997 Edgman ..... E04H 17/1426 256/65.02
7,546,900 B2 * 6/2009 Humphries ..... E01F 8/0017 52/145
7,934,699 B2 * 5/2011 Zell ..... E04H 17/168 256/65.02
8,132,791 B2 * 3/2012 Stucker ..... E04H 17/1447 256/19

(Continued)

FOREIGN PATENT DOCUMENTS

CA 1146393 A1 5/1983
CA 2316023 A1 * 2/2002 ..... E04H 17/168

(Continued)

*Primary Examiner* — Jonathan P Masinick
(74) *Attorney, Agent, or Firm* — Oyen Wiggs Green & Mutala LLP

(57) ABSTRACT

A modular fencing system comprises two or more substantially vertical posts, one or more panels, and one or more track members. Each of the posts comprises abase and an upright member extending from the base. The upright member comprises a plurality of surfaces, and at least one of the surfaces defines a channel. Each of the track members comprises an attachment portion configured to engage within the channel and a receiving portion configured to engage with one or more of the panels.

11 Claims, 22 Drawing Sheets

(56) References Cited

U.S. PATENT DOCUMENTS

| | | | | |
|---|---|---|---|---|
| 10,105,890 | B2 * | 10/2018 | Kelly | E04C 2/52 |
| 10,480,210 | B2 * | 11/2019 | Mouchet | E06B 9/24 |
| 10,718,133 | B1 * | 7/2020 | Maher | E04H 17/165 |
| 11,313,147 | B1 * | 4/2022 | Maher | E01F 13/022 |
| 11,746,559 | B2 * | 9/2023 | Amsellem | E06B 11/02 256/34 |
| 2002/0005512 | A1 * | 1/2002 | Trill | E04H 17/168 256/25 |
| 2002/0185640 | A1 * | 12/2002 | Heins | E04H 17/168 256/65.01 |
| 2003/0213947 | A1 * | 11/2003 | Takagi | E04H 17/1413 256/65.02 |
| 2006/0186391 | A1 * | 8/2006 | Hansen | E06B 3/5454 256/24 |
| 2009/0194753 | A1 | 8/2009 | Stucker | |
| 2019/0284833 | A1 * | 9/2019 | Yeh | E04H 17/1447 |
| 2023/0212875 | A1 * | 7/2023 | Walker | E04H 17/168 256/24 |

FOREIGN PATENT DOCUMENTS

| | | | | |
|---|---|---|---|---|
| CA | 2394995 | A1 * | 1/2004 | E04H 17/168 |
| DE | 19842296 | A1 * | 4/2000 | E04H 17/163 |
| DE | 102005033490 | A1 * | 2/2007 | E04H 17/161 |
| DE | 102015111606 | A1 * | 1/2017 | |
| EP | 1098051 | A1 | 5/2001 | |
| EP | 2196603 | A1 | 6/2010 | |
| EP | 2196604 | A1 * | 6/2010 | E04H 17/16 |
| FR | 2646195 | A1 * | 10/1990 | |
| GB | 2259924 | A * | 3/1993 | E04H 12/2215 |
| KR | 20130104946 | A * | 9/2013 | |

* cited by examiner

MODULAR FENCING SYSTEM

FIELD OF THE INVENTION

The present invention relates to fencing, and in particular, to a modular fencing system.

BACKGROUND OF THE INVENTION

Conventional fences typically comprise a number of vertical posts, with horizonal barriers, such as railings, extending between the posts. In one type of fence, the horizontal barriers may comprise of panels that extend for at least a portion of the height of the posts. The panels may provide more privacy and protection than railings. However, due to their size, the panels may be more difficult to install. In particular, depending on the size of the panels, it may be necessary to use multiple fasteners to secure the panels to the posts. In addition, the panels must be correctly sized in order to ensure a correct fit between the posts.

Modular fencing systems allow for more flexibility in installing a fence. Typically, modular fencing systems use preassembled wood or steel panels that may be installed and replaced individually. However, even though modular fencing systems provide for more flexibility in installing or replacing the panels, it may still be difficult and time-consuming in attaching the panels to the posts.

It is desired for a modular fencing system with panels that are easy and convenient to install.

SUMMARY OF THE INVENTION

In accordance with one embodiment of the invention, a modular fencing system comprises two or more substantially vertical posts, one or more panels, and one or more track members. Each of the posts comprises a base and an upright member extending from the base. The upright member comprises a plurality of surfaces, and at least one of the surfaces defines a channel. Each of the track members comprises an attachment portion configured to engage within the channel and a receiving portion configured to engage with one or more of the panels.

In another aspect, the at least one of the surfaces comprises a planar section and two angled sections extending from the planar section. The planar section and the two angled sections define, at least in part, the channel.

In yet another aspect, the attachment portion comprises an attachment surface and two angled surfaces extending from the attachment surface. The attachment surface and the two angled surfaces are configured to engage within the channel.

In still yet another aspect, the receiving portion comprises a wing extending from the attachment portion. The wing is configured to engage with one or more of the panels.

In a further aspect, the wing comprises one or more wing openings, and the panel comprises one or more panel openings. The wing openings and the panel openings are configured to receive panel fasteners therethrough for securing the wing to the panel.

In still a further aspect, each of the track members engages with one of the panels.

In still yet a further aspect, the planar section comprises one or more planar section openings, and the attachment surface comprises one or more attachment surface openings. The planar section openings are configured to receive post fasteners therethrough for securing the track member to the upright member.

In another aspect, the receiving portion comprises two wings extending from the attachment portion. The wings are configured to engage with one or more of the panels.

In yet another aspect, the wings are substantially parallel to each other.

In still yet another aspect, each of the wings comprises one or more inward-facing protrusions.

The foregoing was intended as a summary only and of only some of the aspects of the invention. It was not intended to define the limits or requirements of the invention. Other aspects of the invention will be appreciated by reference to the detailed description of the preferred embodiments.

BRIEF DESCRIPTION OF THE DRAWINGS

The embodiments of the invention will be described by reference to the drawings thereof, in which.

DETAILED DESCRIPTION OF THE INVENTION

Figure 1:
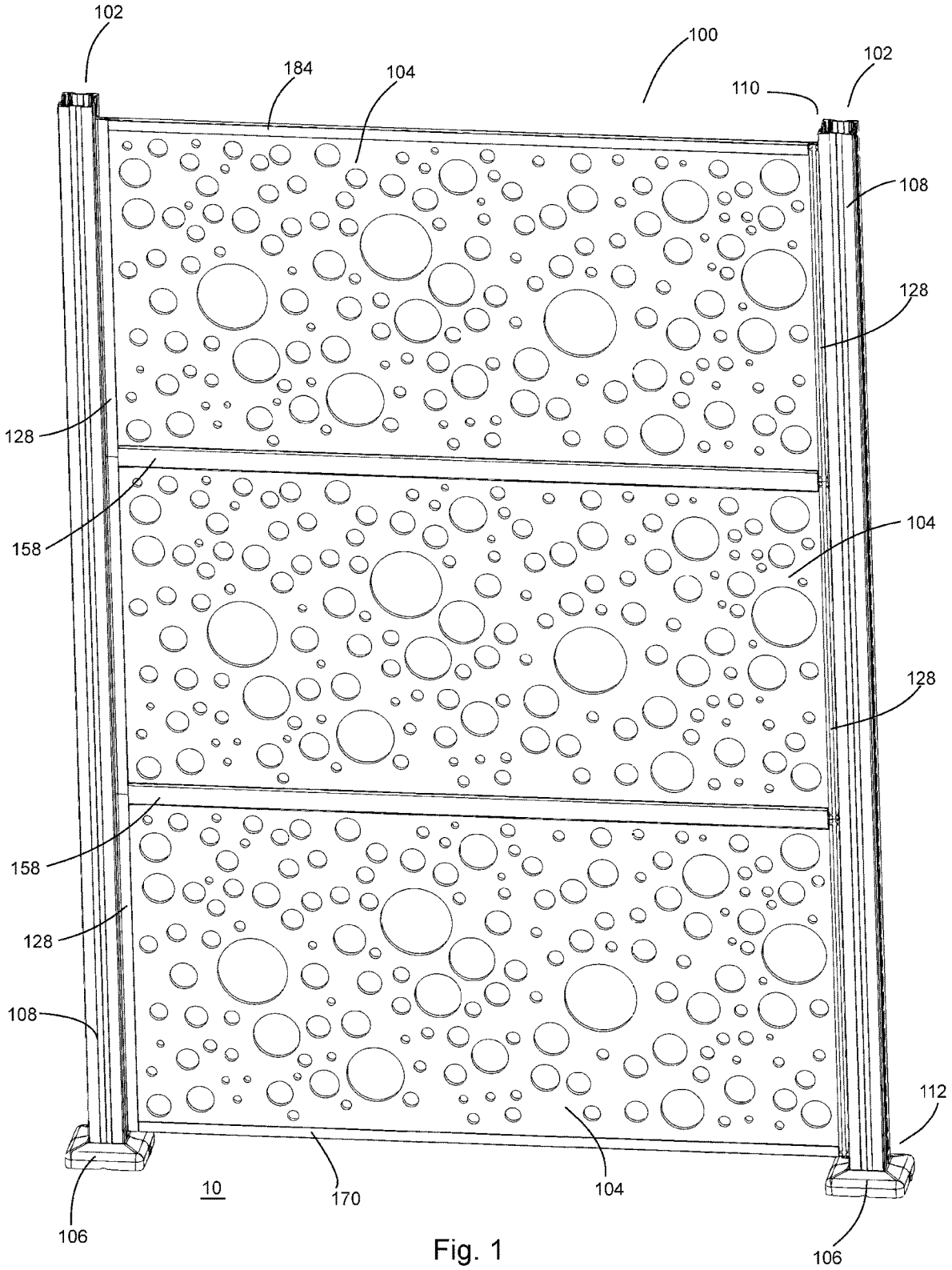
FIG. 1 shows the fencing system in accordance with one embodiment of the invention.
Figure 2:
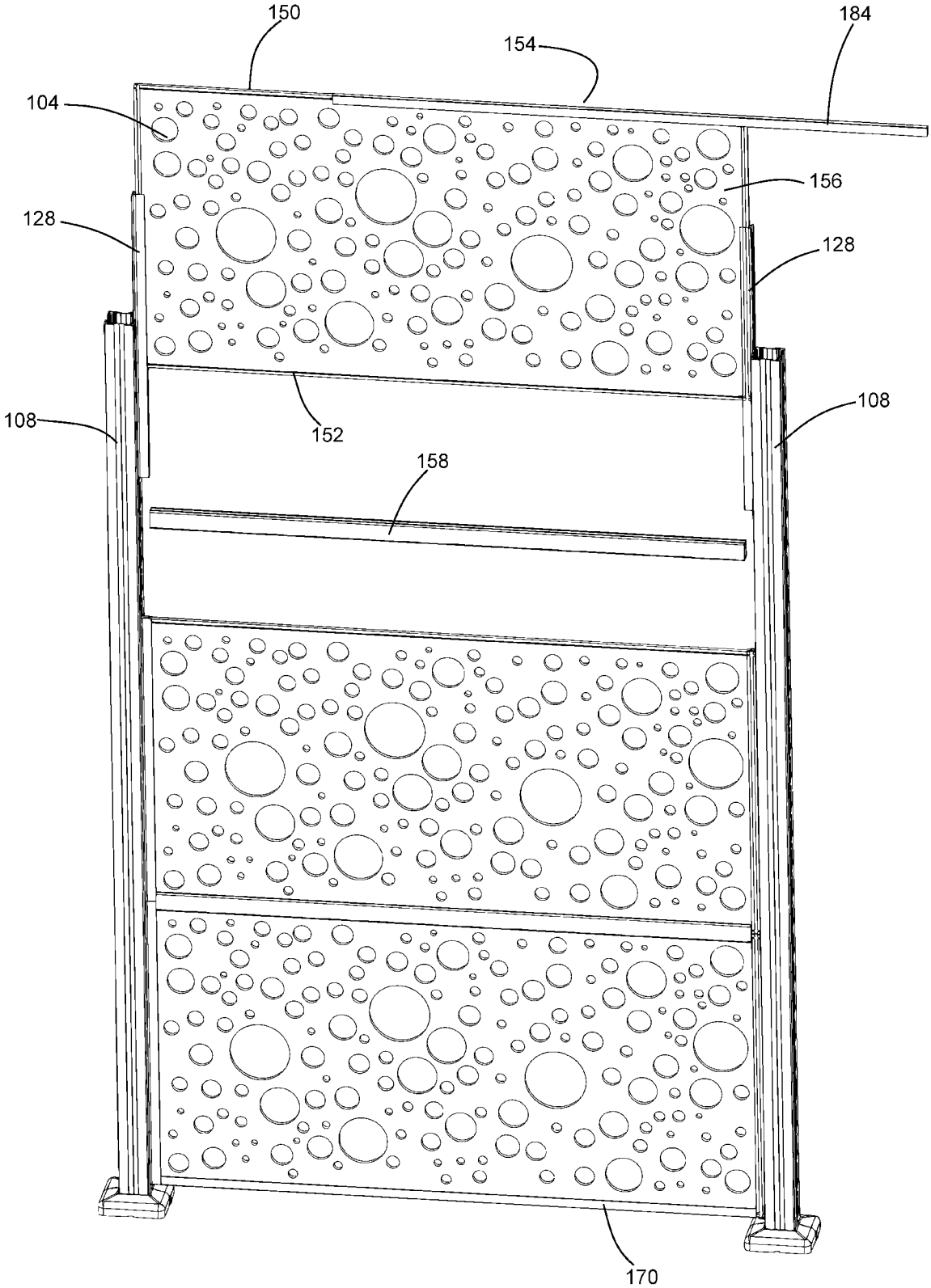
FIG. 2 is an exploded view of the fencing system of FIG. 1.
Figure 3:
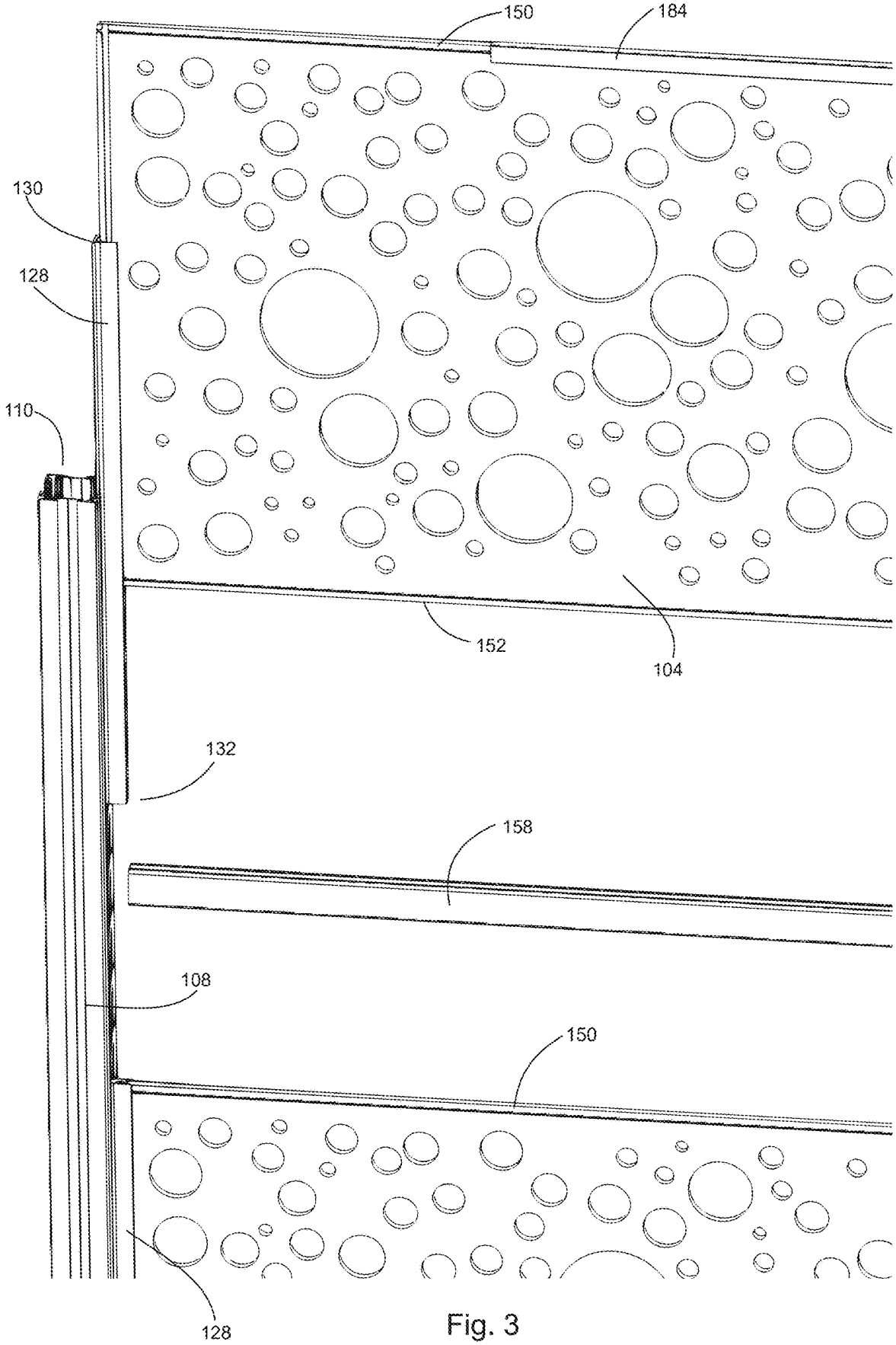
FIG. 3 is a partial view of FIG. 2.
Figure 4:
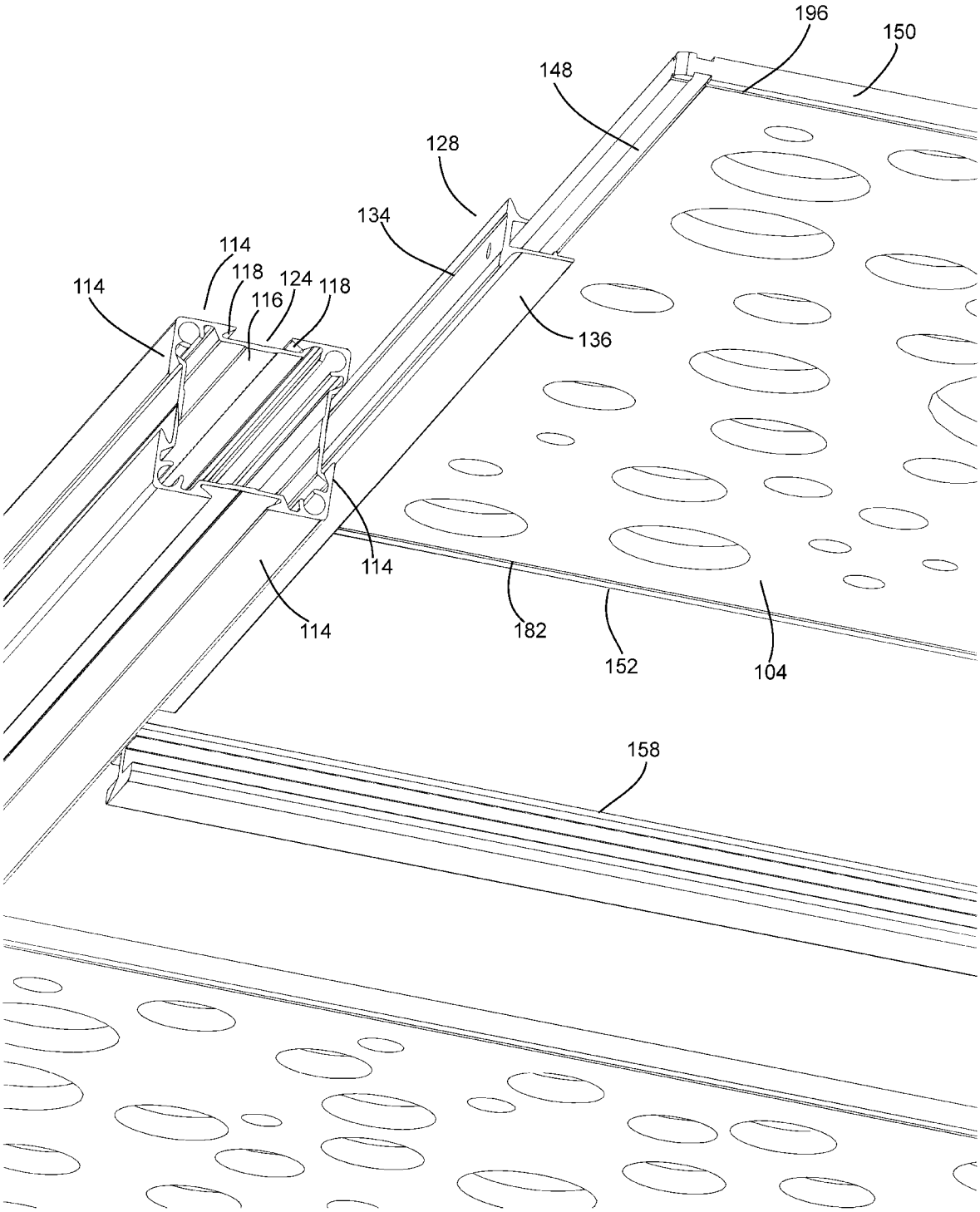
FIG. 4 is another partial exploded view of the fencing system of FIG. 1.
Figure 5:
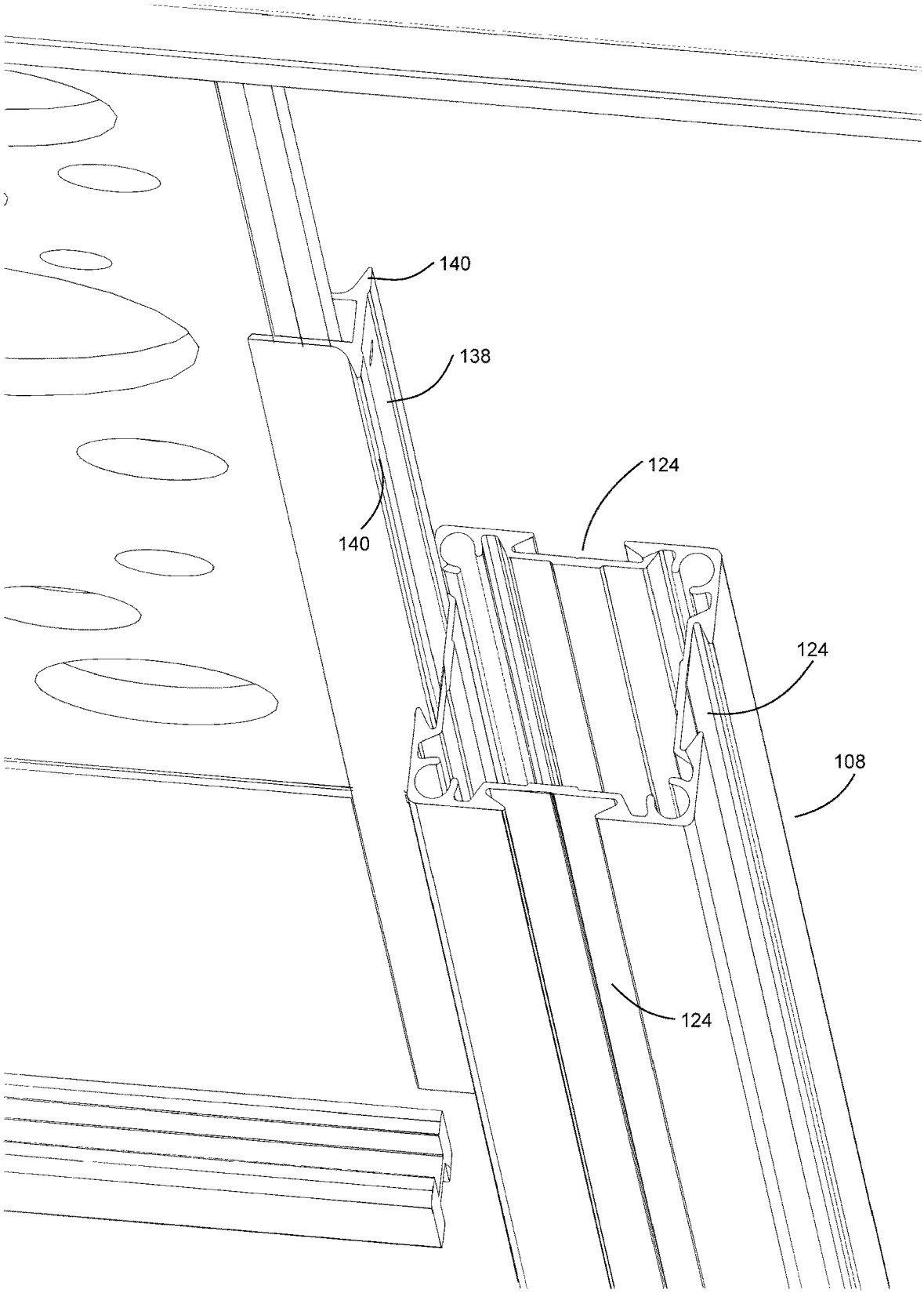
FIG. 5 is another partial exploded view of the fencing system of FIG. 1.

Referring to FIG. 1, a modular fencing system 100 comprises a plurality of substantially vertical posts 102 and one or more panels 104. Preferably, each of the panels 104 extend between two of the posts 102, as shown in FIG. 1. FIG. 1 depicts the fencing system 100 with two of the posts 102 and three of the panels 104 extending between two of the posts 102 and in a stacked configuration; however, it is understood that additional ones of the panels 104 and additional ones of the posts 102 may be used to extend the overall length of the fencing system 100. The panels 104 may be formed from plastic or another suitable material.

Each of the posts 102 preferably comprises a base 106 and a generally upright member 108 extending from the base 106. The base 106 may be attached to the ground 10 or some other flooring using base fasteners 107 (not shown) in order to secure the posts 102. The upright member 108 comprises upright member first and second ends 110, 112, with the base 106 attached to the upright member 108 proximate to the upright member second end 112.

Referring to FIGS. 1 to 7, the upright member 108 is generally hollow and may be constructed from metal. The upright member 108 preferably comprises a plurality of surfaces 114. In the embodiment shown in FIGS. 1 to 7, the surfaces 114 comprise four of the surfaces 114 that are arranged so that the surfaces 114 form a generally rectangular cross-section when viewed from above. More preferably, the surfaces 114 have a width that is substantially similar to each other, such that the generally rectangular cross-section is substantially square.

Each of the surfaces 114 comprises a planar section 116 extending between two angled sections 118. The planar section 116 comprises planar section ends 120, and the angled sections 118 comprise angled section ends 122. Preferably, the planar section 116 is attached to the angled sections 118 proximate to the planar section ends 120 and the one of the angled section ends 122. The planar section 116 and the angled sections 118 define, at least in part, a substantially vertical channel 124 that extends from the upright member first end 110 for at least a portion of the height of the surfaces 114. In the embodiment shown in FIGS. 1 to 7, the channels 124 extend for substantially an entire height of the surfaces 114. Referring to FIG. 7, preferably, the channels 124 have a generally trapezoidal cross-section when viewed from above, with the other one of the angled section ends 122 defining an opening 126 that also extends from the upright member first end 110 for at least a portion of the height of the surfaces 110.

Figure 6:
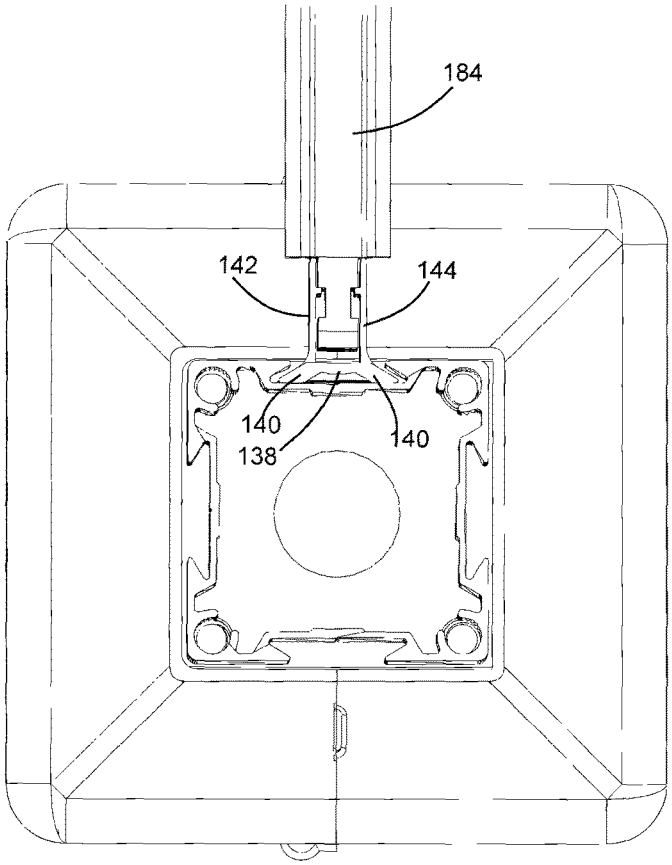
FIG. 6 is a partial top view of the fencing system of FIG. 1.
Figure 7:
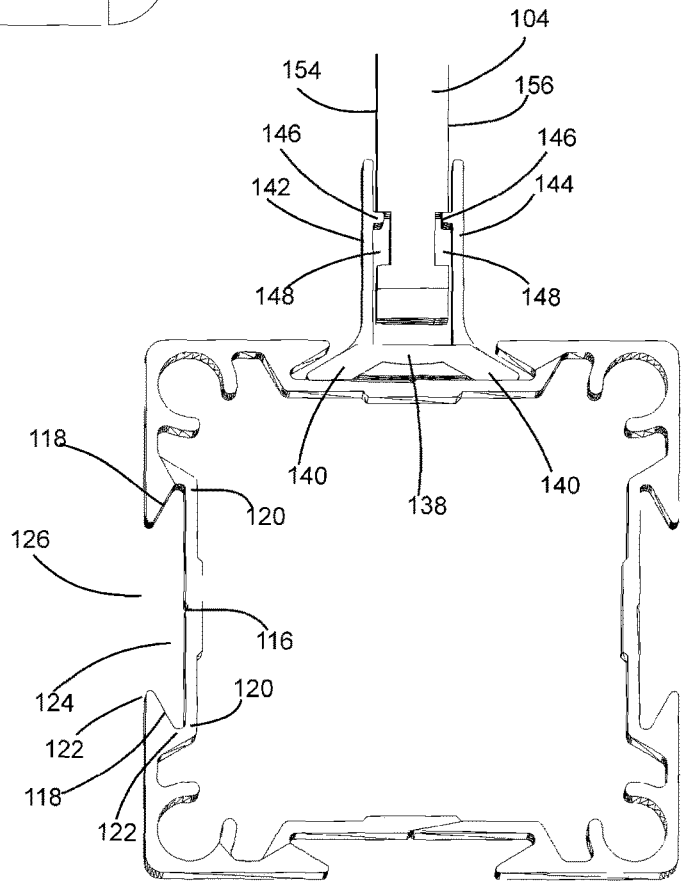
FIG. 7 is another partial top view of the fencing system of FIG. 1, with the base omitted.

FIGS. 6 and 7 depict a portion of the fencing system 100 when viewed from above; however, in FIG. 7, the base 106 has been omitted to better illustrate other portions of the fencing system 100.

Figure 8:
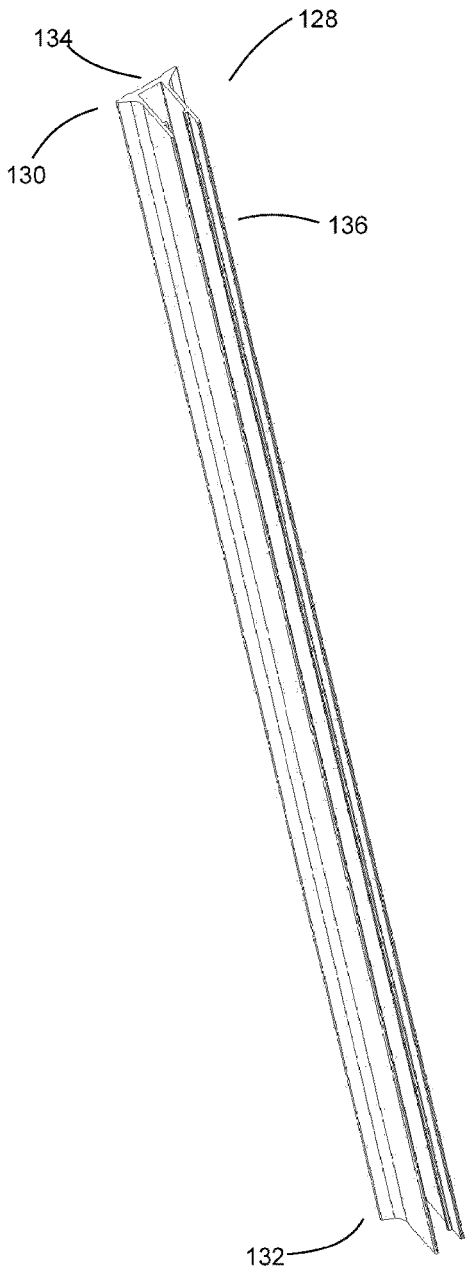
FIG. 8 shows the track member of the fencing system of FIG. 1.
Figure 9:
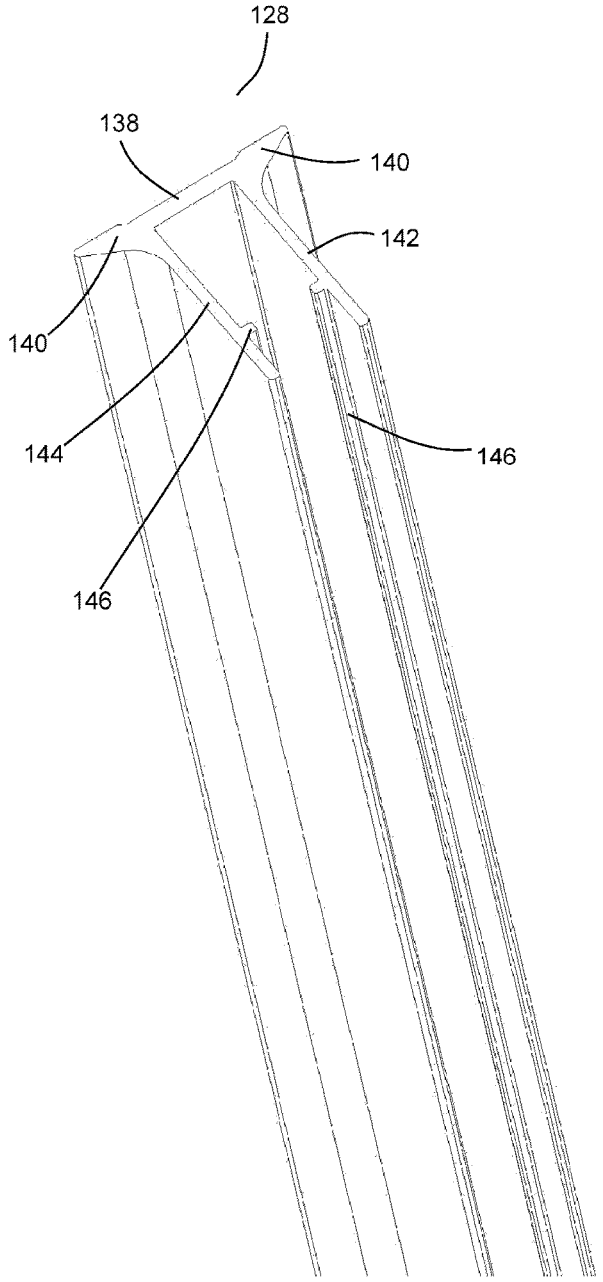
FIG. 9 is a partial view of the track member of FIG. 8.

One or more of the surfaces 114 are configured to engage with one or more elongated track members 128. Referring to FIGS. 8 and 9, each of the track members 128 comprises track member first and second ends 130, 132 located at longitudinal ends of the track member 128. Furthermore, the track member 128 comprises an attachment portion 134 connected to a receiving portion 136. Preferably, the attachment portion 134 and the receiving portion 136 are both elongated and extend between the track member first and second ends 130, 132.

The attachment portion 134 is configured to engage within one of the channels 124, as shown in FIG. 7. The attachment portion 134 comprises an attachment surface 138 that corresponds to or engages generally with the planar section 116. The attachment portion 134 further comprises two angled surfaces 140 that correspond generally with the angled sections 118.

The engagement of the attachment portion 134 with the channel 124 may be carried out by slidably inserting the attachment portion 134 within the channel 124, such as by inserting the track member 128 proximate to the track member second end 132 into the channel 124 proximate to the upright member first end 110. Once inserted, the track member 128 may be slid along the channel 124, until either the track member 128 reaches the end of the channel 124 or, if the channel 124 extends for an entire height of the upright member 108, the track member 128 reaches the base 106.

If the track member 128 is not of sufficient height to extend for the entire height of the channel 124 when inserted into the channel 124, additional ones of the track members 128 may be inserted into the channel 124. In this manner, the channel 124 may be able to accommodate more than one track members 128 that are placed on top of each other.

The receiving portion 136 is configured to engage with one of the panels 104. Referring to FIG. 9, the receiving portion 136 comprises first and second wings 142, 144 extending from the angled surfaces 140 and arranged substantially parallel to each other. The distance between the first and second wings 142, 144 preferably is similar to a width of the panel 104 so that the panel is able to snugly engage between the first and second wings 142, 144.

Preferably, one or more longitudinal protrusions 146 extend along the first and second wings 142 for at least a portion of the height of the first and second wings 142, 144. The protrusions 146 preferably extend inwardly from the first and second wings 142, 144 such that they extend toward each other, as shown in FIG. 9.

The panels 104 comprise first and second panel ends 150, 152 and panel first and second surfaces 154, 156. Preferably, one or more notches 148 extend substantially vertically along the panel first and second surfaces 154, 156 from the first panel end 150 to the second panel end 152, with the notches 148 configured to engage with the protrusions 146 to secure the panel 104 to the track member 128.

Although each one of the panels 104 preferably extends between two of the posts 102, the panels 104 may also be arranged on top of each other to create a higher barrier for the fencing system 100, as shown in FIG. 1. In such configurations, depending on the relative heights of the track members 128 and the panels 104, one of the track members 128 may accommodate and secure multiple ones of the panels 104 to the posts 102, such as, for example, if the track members 128 are greater in height than the panels 104. Alternatively, if the panels 104 are greater in height than the track members 128, multiple ones of the track members 128 may be necessary to secure one of the panels to the posts 102.

Figure 10:
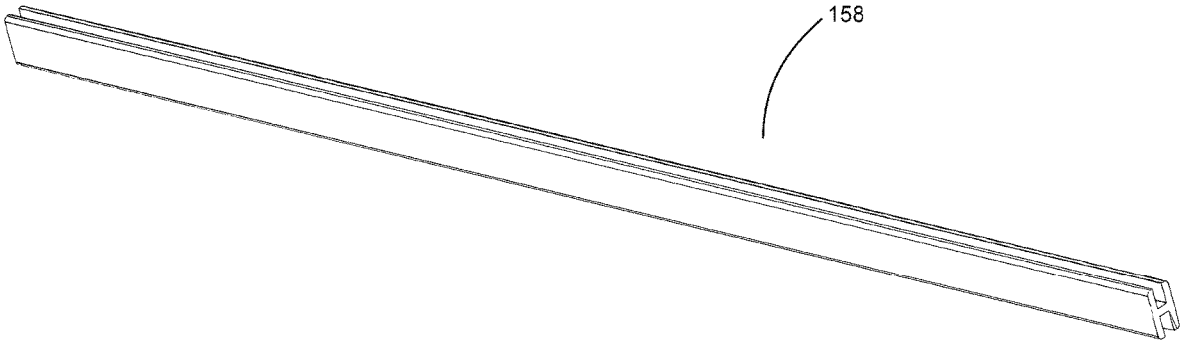
FIG. 10 shows the support member of the fencing system of FIG. 1.
Figure 11:
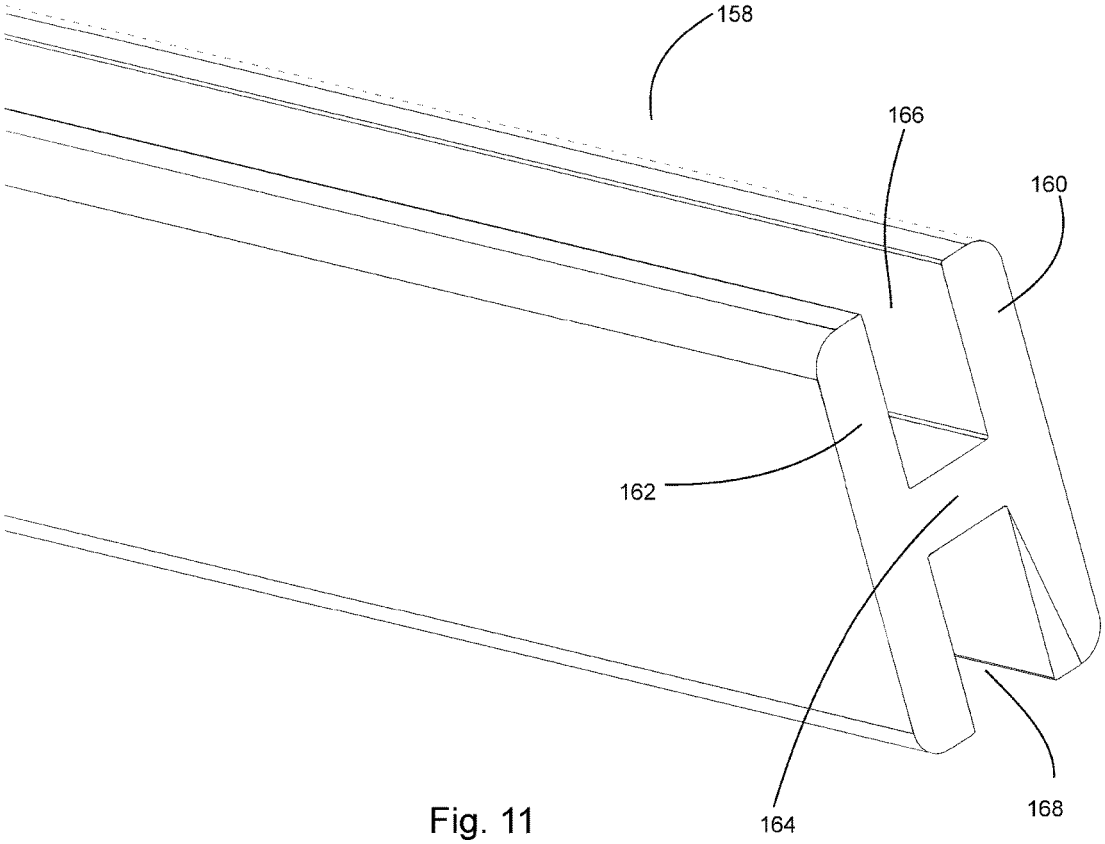
FIG. 11 is a partial view of the support member of FIG. 10.

Referring to FIGS. 10 and 11, the fencing system 100 may also comprise one or more elongated support members 158 to provide a divider between two of the panels 104 that are arranged on top of each other. The support member 158 comprises support member first and second wings 160, 162 that are arranged substantially parallel to each other. A support member divider 164 extends between the support member first and second wings 160, 162, forming a generally H-shaped cross-sectional profile. The support member first and second wings 160, 162 and the support member divider 164 define, at least in part, support member first and second channels 166, 168 for engaging with the panels 104. For example, where two of the panels 104*a*, 104*b* are arranged on top of each other, the panel second end 152*a* of the panel 104*a* may engage with the support member first channel 166, while the panel first end 150*b* of the panel 104*b* may engage with the support member second channel 168.

Preferably, the support members 158 have a length that is slightly shorter than a width of the panels 104. For example, the support members 158 may have a length that is less than the distance between the notches 148 on the panels 104. This will allow the support members 158 to be inserted onto the panels 104 but still provide sufficient clearance for the first and second wings 142, 144 to engage the notches 148 without interference from the support members 158. Alternatively, the lengths of the support members 158 may be such that a number of support members 158 may be inserted onto the panels 104 in a substantially side-by-side arrangement and still provide sufficient clearance for the first and second wings 142, 144 to engage the notches 148.

Figure 12:
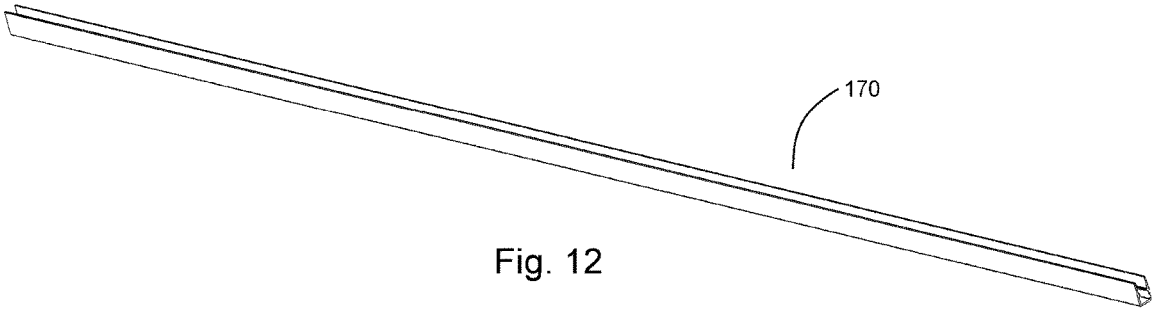
FIG. 12 shows the lower member of the fencing system of FIG. 1.
Figure 13:
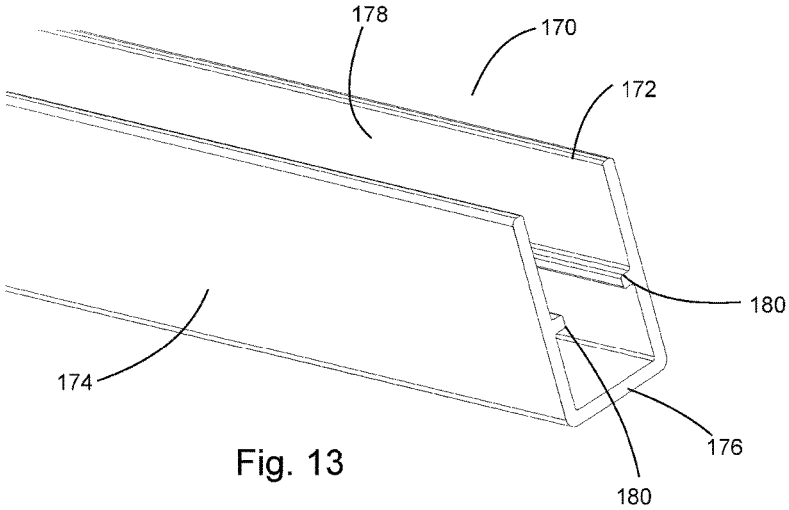
FIG. 13 is a partial view of the lower member of FIG. 12.

Referring to FIGS. 12 and 13, the fencing system 100 may also comprise one or more elongated lower members 170. The lower member 170 comprises lower member first and second wings 172, 174 that are arranged substantially parallel to each other. A lower member central portion 176 extends between the lower member first and second wings 172, 174, forming a generally C-shaped cross-sectional profile. The lower member first and second wings 172, 174 and the lower member central portion 176 define, at least in part, a lower member channel 178 for engaging with the panels 104. For example, the lower member channel 178 may be configured to engage with the panel second end 152 of the panel 104.

The lower member first and second wings 172, 174 may comprise inward-facing lower member protrusions 180. The lower member protrusions 180 may be configured to engage with substantially horizontal panel lower notches 182 formed on the panel first and second surfaces 154, 156 proximate to the panel second end 152.

Preferably, the lower members 170 have a length that is slightly shorter than a width of the panels 104. For example, the lower members 170 may have a length that is less than the distance between the notches 148 on the panels 104. This will allow the lower members 170 to be inserted onto the panel 104 but still provide sufficient clearance for the first and second wings 142, 144 to engage the notches 148 without interference from the lower members 170. Alternatively, the lengths of the lower members 170 may be such that a number of lower members 170 may be inserted onto the panels 104 in a substantially side-by-side arrangement and still provide sufficient clearance for the first and second wings 142, 144 to engage the notches 148.

Figure 14:
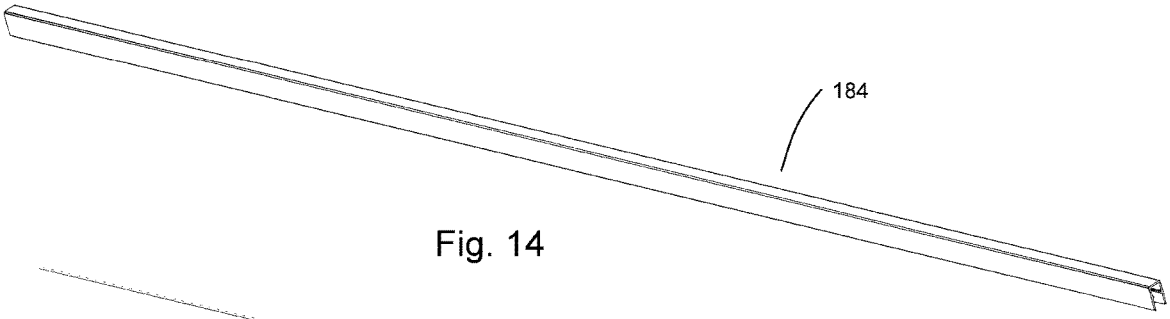
FIG. 14 shows the upper member of the fencing system of FIG. 1.
Figure 15:
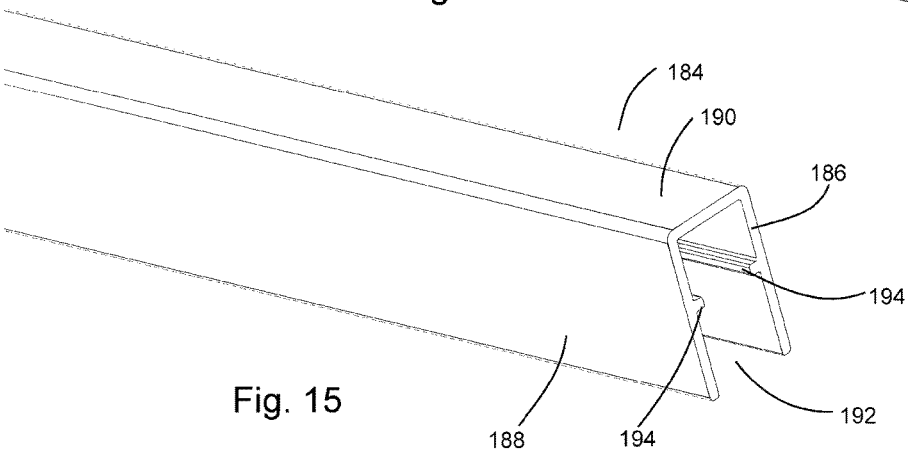
FIG. 15 is a partial view of the upper member of FIG. 14.
Figure 16:
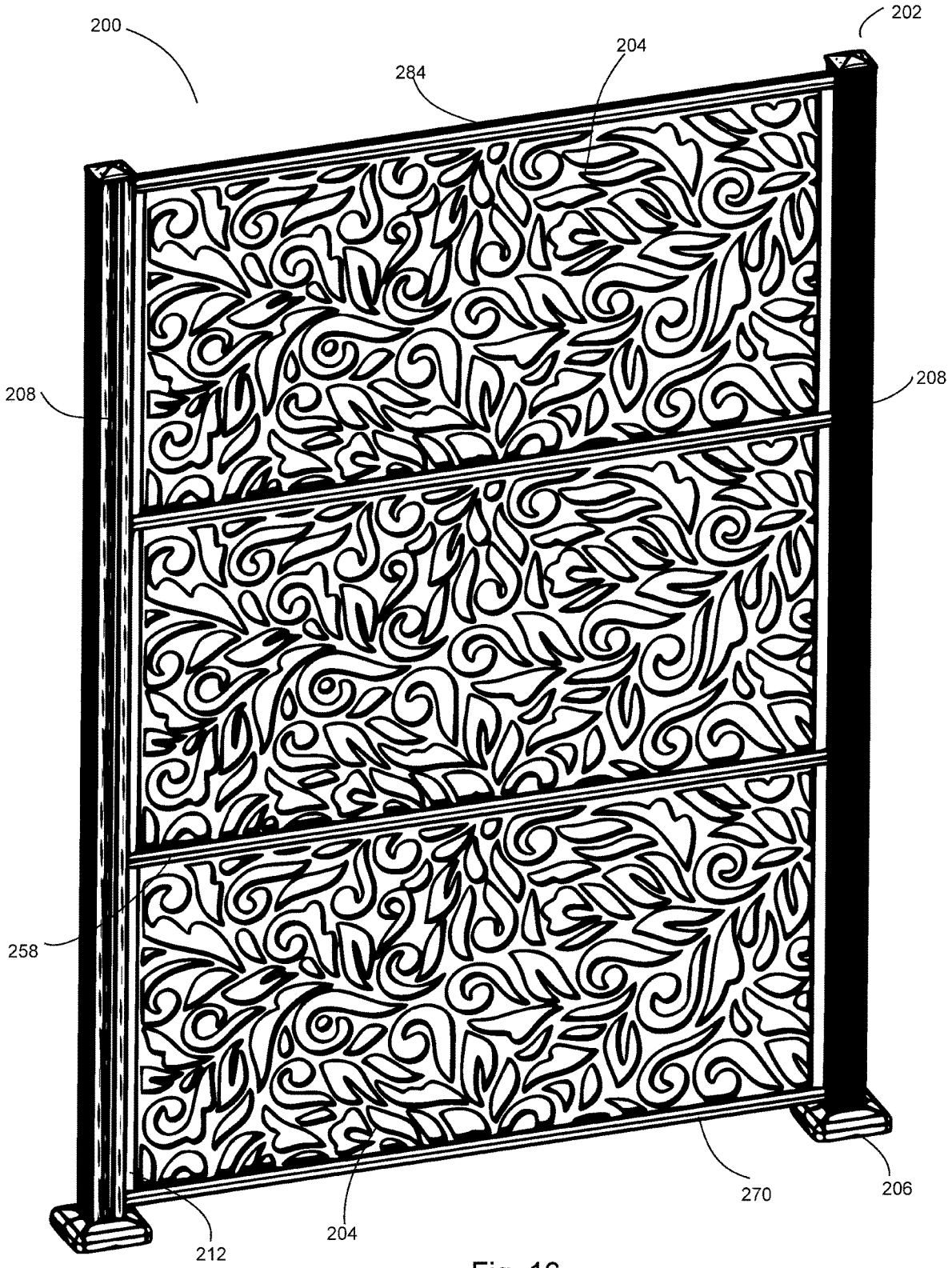
FIG. 16 shows the fencing system in accordance with a second embodiment of the invention.
Figure 17:
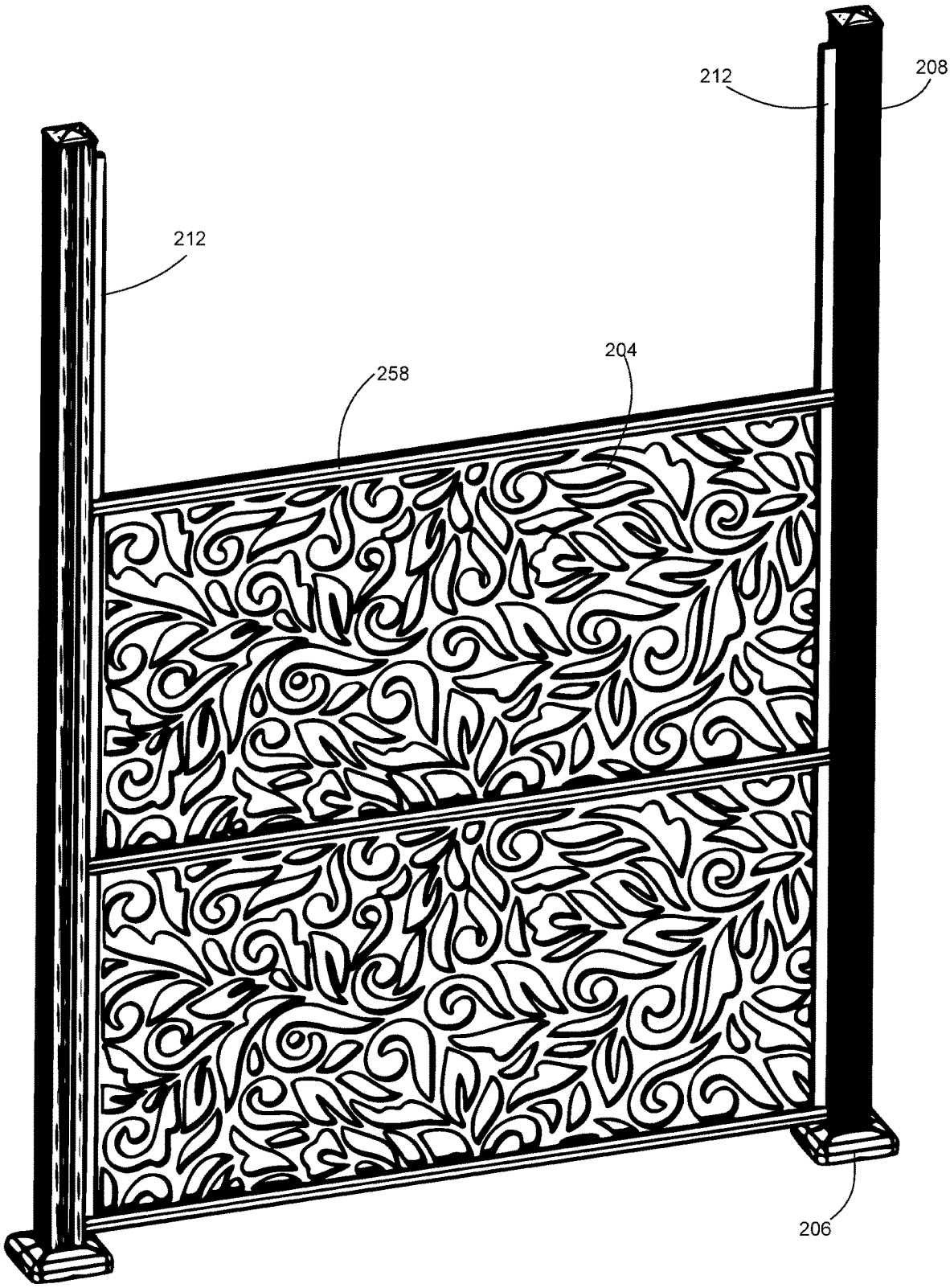
FIG. 17 shows the fencing system of FIG. 16, with one of the panels removed.
Figure 18:
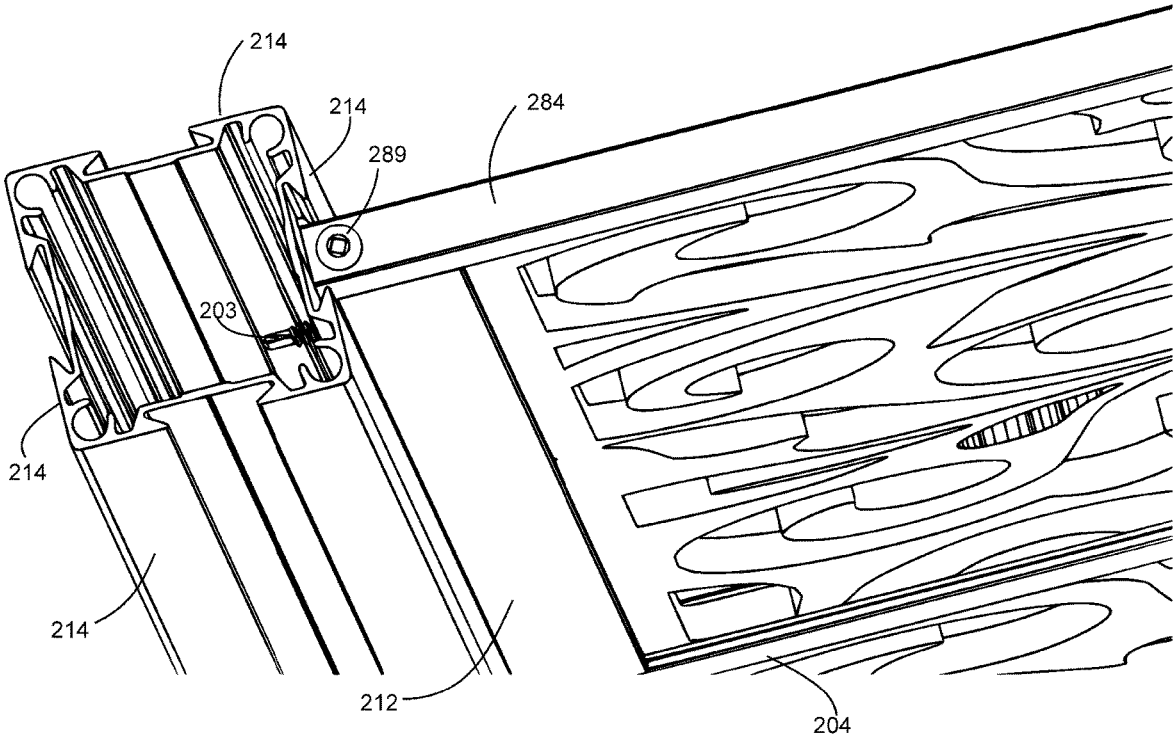
FIG. 18 is a partial perspective view of the fencing system of FIG. 16.
Figure 19:
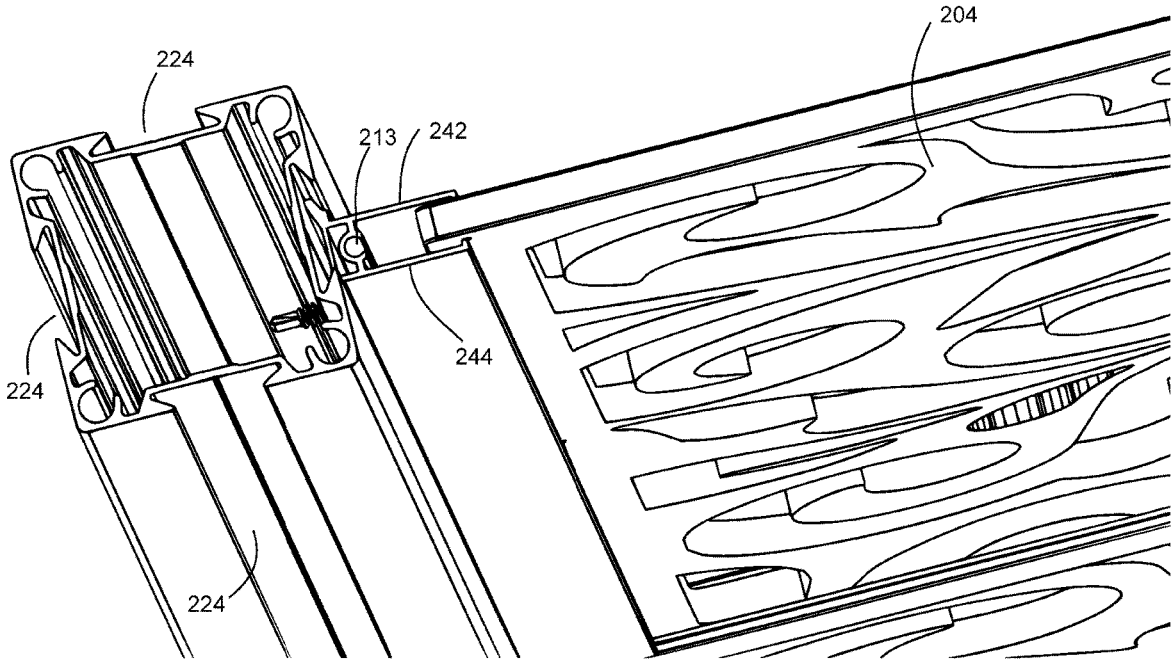
FIG. 19 is another partial perspective view of the fencing system of FIG. 16, with the upper member removed.
Figure 20:
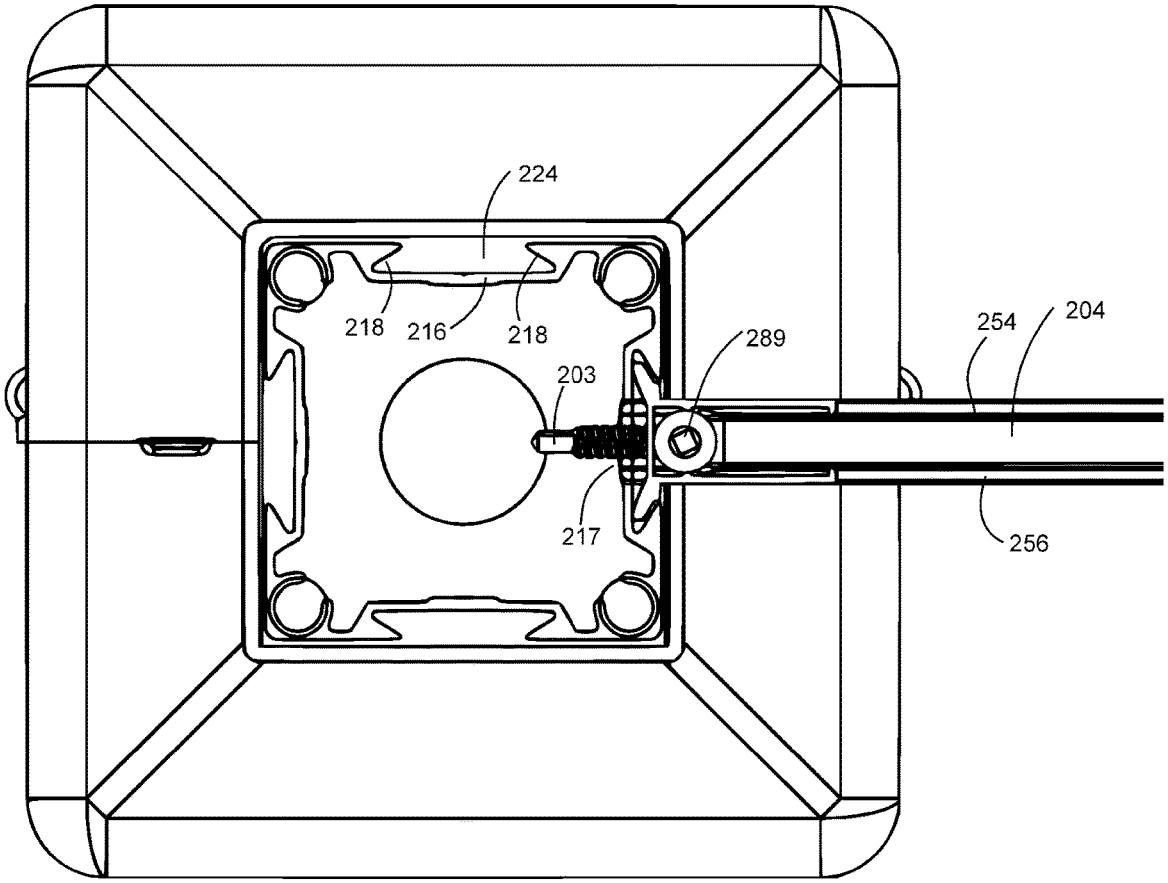
FIG. 20 is a partial top view of the fencing system of FIG. 16.
Figure 21:
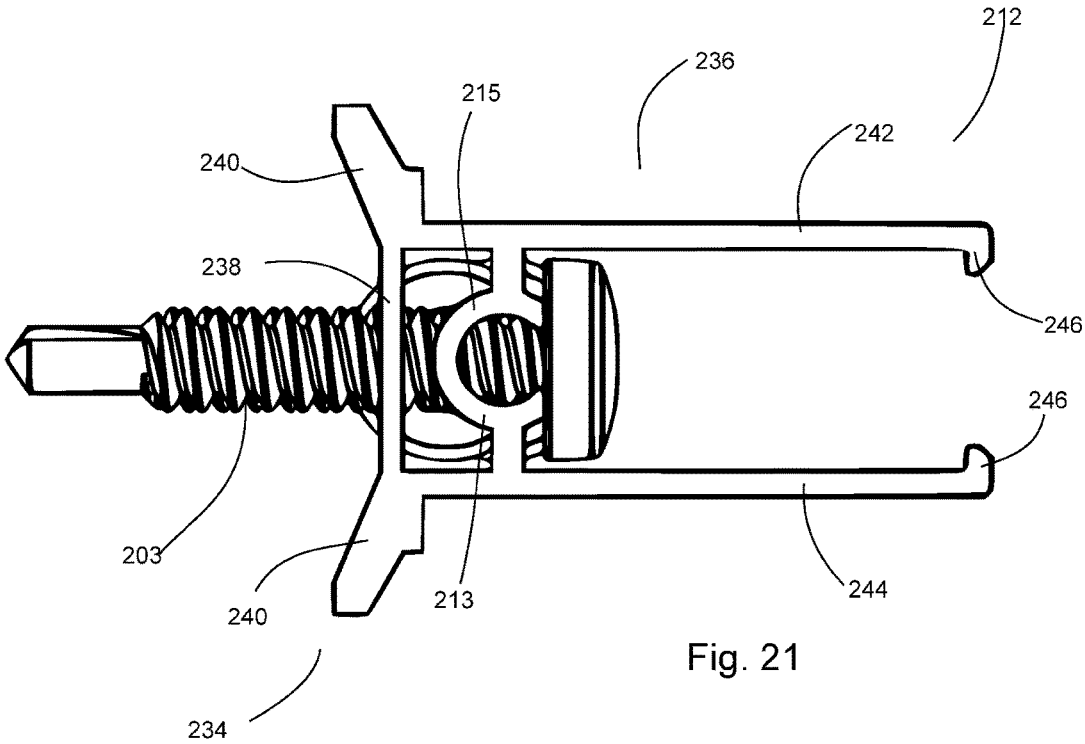
FIG. 21 is a top view showing the track member of the fencing system of FIG. 16.
Figure 22:
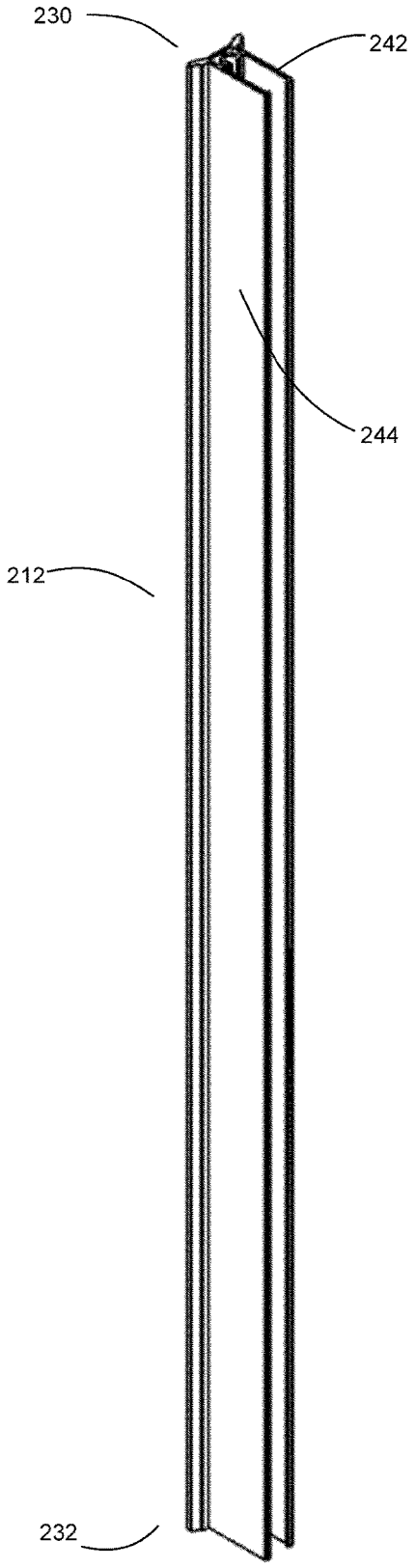
FIG. 22 is a perspective view of the track member of FIG. 16.
Figure 23:
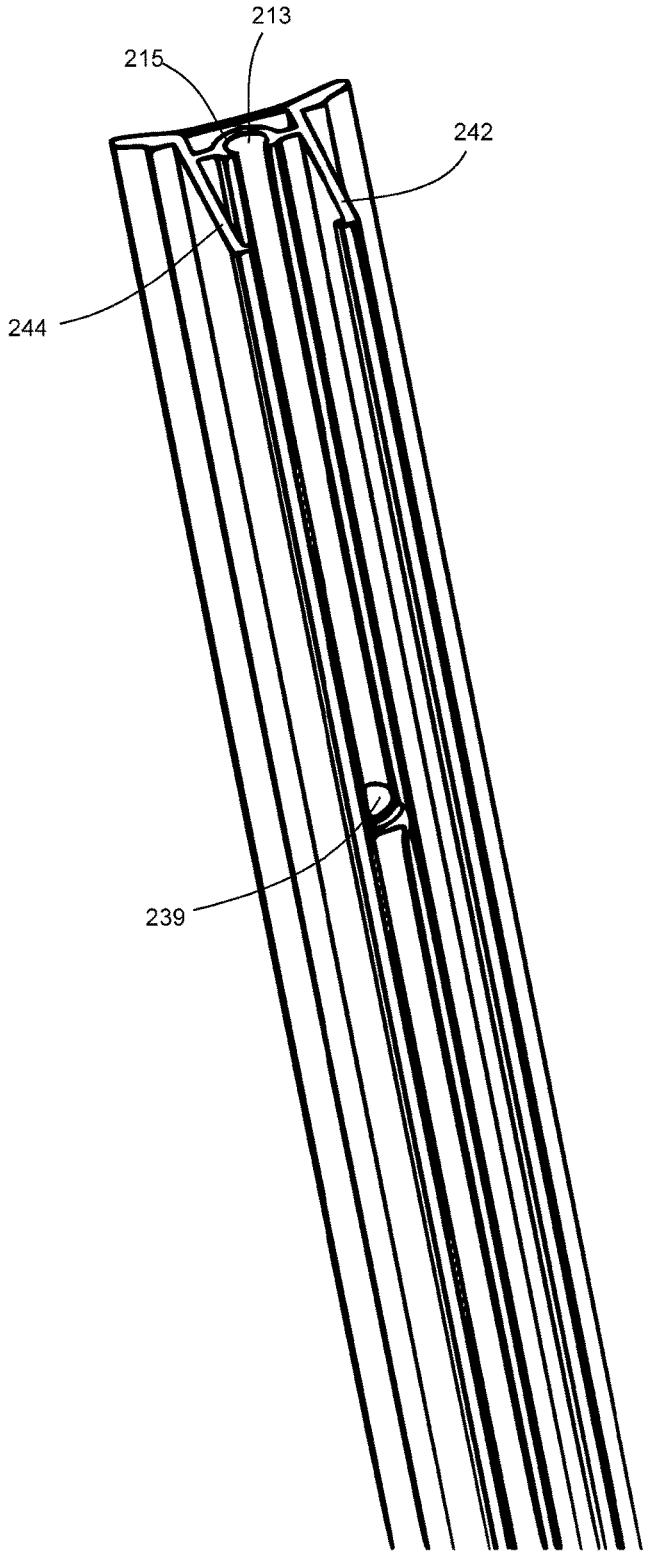
FIG. 23 is a partial view of the track member of FIG. 22.

Referring to FIGS. 14 and 15, the fencing system 100 may also comprise one or more elongated upper members 184. The upper member 184 comprises upper member first and second wings 186, 188 that are arranged substantially parallel to each other. An upper member central portion 190 extends between the upper member first and second wings 186, 188, forming a generally C-shaped cross-sectional profile. The upper member first and second wings 186, 188 and the upper member central portion 190 define, at least in part, an upper member channel 192 for engaging with the panels 104. For example, the upper member channel 192 may be configured to engage with the panel first end 150 of the panel 104. The upper member first and second wings 186, 188 may comprise inward-facing upper member protrusions 194. The upper member protrusions 194 may be configured to engage with substantially horizontal panel upper notches 196 formed on the panel first and second surfaces 154, 156 proximate to the panel first end 150.

Preferably, the upper members 184 have a length that is slightly shorter than a width of the panels 104. For example, the upper members 184 may have a length that is less than the distance between the notches 148 on the panels 104. This will allow the upper members 184 to be inserted onto the panel 104 but still provide sufficient clearance for the first and second wings 142, 144 to engage the notches 148 without interference from the lower members 170. Alternatively, the lengths of the upper members 184 may be such that a number of upper members 184 may be inserted onto the panels 104 in a substantially side-by-side arrangement and still provide sufficient clearance for the first and second wings 142, 144 to engage the notches 148.

The following is an example of the installation of the fencing system 100. First, two of the posts 102 may first be attached to the ground 10 via the bases 106. Next, one or more of the track members 128 are inserted into one of the channels 124 of the upright member 108 of each of the posts 102. The channels 124 in which the upright members 108 are installed should be on the surfaces 114 that face each other. This may be done by inserting the track member second end 132 into the channels 124 at the upright member first end 110 and allowing the track member 128 to slide down. Additional ones of the track members 128 may be inserted into the channels 124.

One or more of the lower members 170 are then attached to a first one of the panels 104. This may be done by inserting the panel second end 152 into the lower member channel 178 by slidably engaging the lower member protrusions 180 with the panel lower notches 182. Depending on the relative lengths of the panel 104 and the lower members 170, multiple ones of the lower members 170 may be attached.

The panel 104 (with the lower member(s) 170 attached) can then be attached to the track members 128 by slidably inserting the panel second end 152 into the receiving portions 136 of the track members 128 of the two posts 102 at the track member first end 130.

If the fencing system 100 comprises multiple ones of the panels 104 placed on top of each other, one or more of the support members 158 are attached to the first one of the panels 104. This may be done by placing the support members 158 on the panel first end 150 such that the panel first end 150 is inserted into the support member second channel 168. The second one of the panels 104 can then be inserted using the track members 128 until the panel second end 152 of the second one of the panels 104 is inserted into the support member first channel 166. This may be repeated as necessary for additional ones of the panels 104 to be placed on top of each other.

For the uppermost one of the panels 104, before it is inserted on top of the other ones of the panels 104, one or more of the upper members 184 are installed. This may be done by inserting the panel first end 150 into the upper member channel 192 by slidably engaging the upper member protrusions 194 with the panel upper notches 196. Depending on the relative lengths of the panel 104 and the upper members 184, multiple ones of the upper members 184 may be attached. Once the upper members 184 have been installed on the uppermost one of panels 104, it may be inserted on top of the other ones of the panels 104.

FIGS. 16 to 29 depict another embodiment of the invention. In this embodiment, the fencing system 200 also comprises substantially vertical posts 202 and one or more panels 204. The panels 204 may be made from plastic.

Each of the posts 202 preferably comprises base 206 and generally upright member 208 extending from the base 206. The upright member 208 is substantially similar in configuration to the upright member 108 of the previous embodiment. In particular, channels 224 are formed on surfaces 214 of the upright member 208, with the channels 224 being defined, at least in part, by planar section 216 and two angled sections 218. However, in this embodiment, the planar section 216 comprises one or more planar section openings 217 located at one or more locations along a height of the channels 224. The planar section openings 217 are configured to accept post fasteners 203 therethrough. The post fasteners 203 may include screws, bolts, or any other suitable mechanical fasteners.

Referring to FIGS. 18 to 23, elongated track members 212 comprise attachment portion 234 and receiving portion 236. The attachment portion 234 comprises attachment surface 238 and two angled surfaces 240 extending from the attachment surface 238. The attachment surface 238 and the angled surfaces 240 are configured to engage within one of the channels 224. The attachment surface 238 comprises one or more attachment surface openings 239 that are preferably aligned with the planar section openings 217 when the track member 212 is installed in the channel 224. The attachment surface openings 239 are also configured to accept the post fasteners 203 therethrough and allow the track member 212 to be secured to the planar section 216.

The receiving portion 236 comprises first and second wings 242, 244 extending from the attachment portion 234. Preferably, inward-facing protrusions 246 extend from the first and second wings 242, 244. However, in this embodiment, the notches 148 present in the previous embodiment are preferably not present. The protrusions 246 preferably simply grip panel first and second surfaces 254, 256 (instead of engaging notches on the panels 204).

Figure 24:
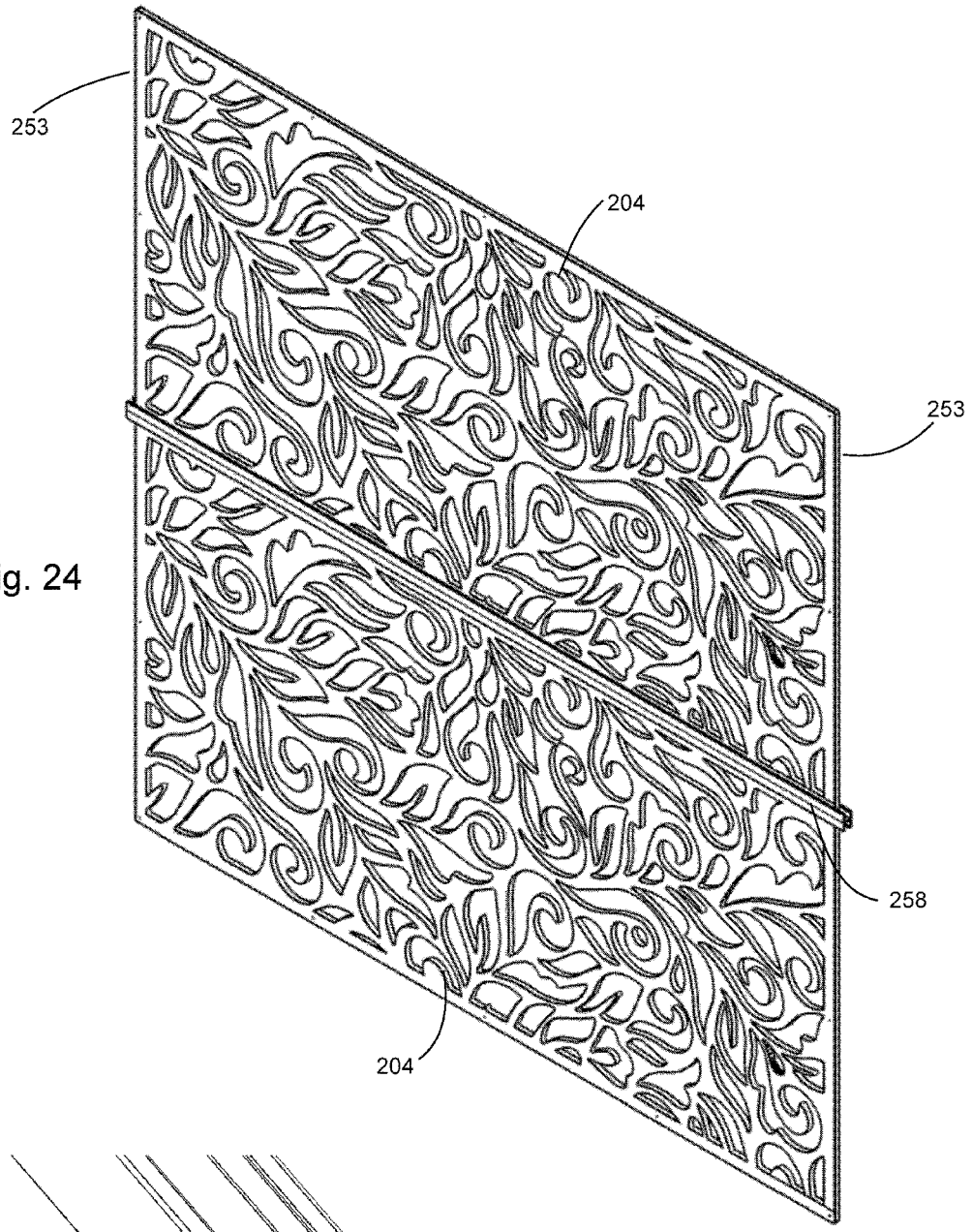
FIG. 24 is a partial view of the fencing system of FIG. 16, showing two of the panels and the support member.
Figure 25:
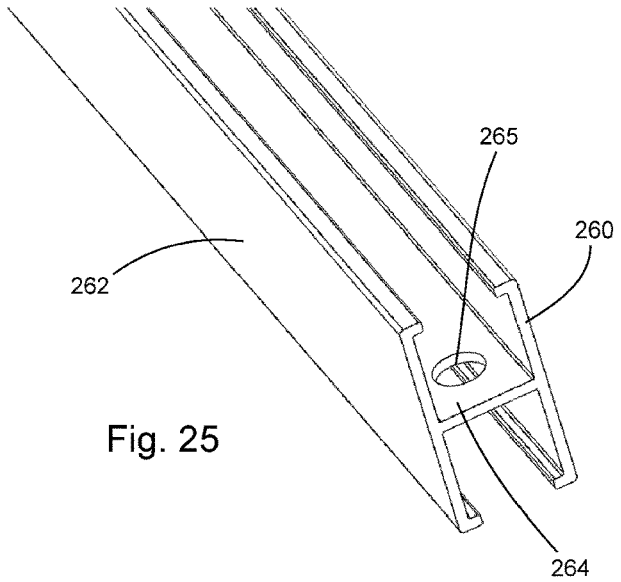
FIG. 25 is a partial view of the support member of FIG. 24.

Referring to FIGS. 24 to 25, the fencing system 200 may comprise elongated support members 258 that are similar in configuration to support members 158 of the previous embodiment. In particular, the support members 258 comprise support member divider 264 extending between support member first and second wings 260, 262. However, the support member divider 264 comprises one or more divider openings 265 that are configured to accept panel fasteners therethrough. The panel fasteners may be used to secure the panels 204 in place (either above or below the support member 258).

Figure 26:
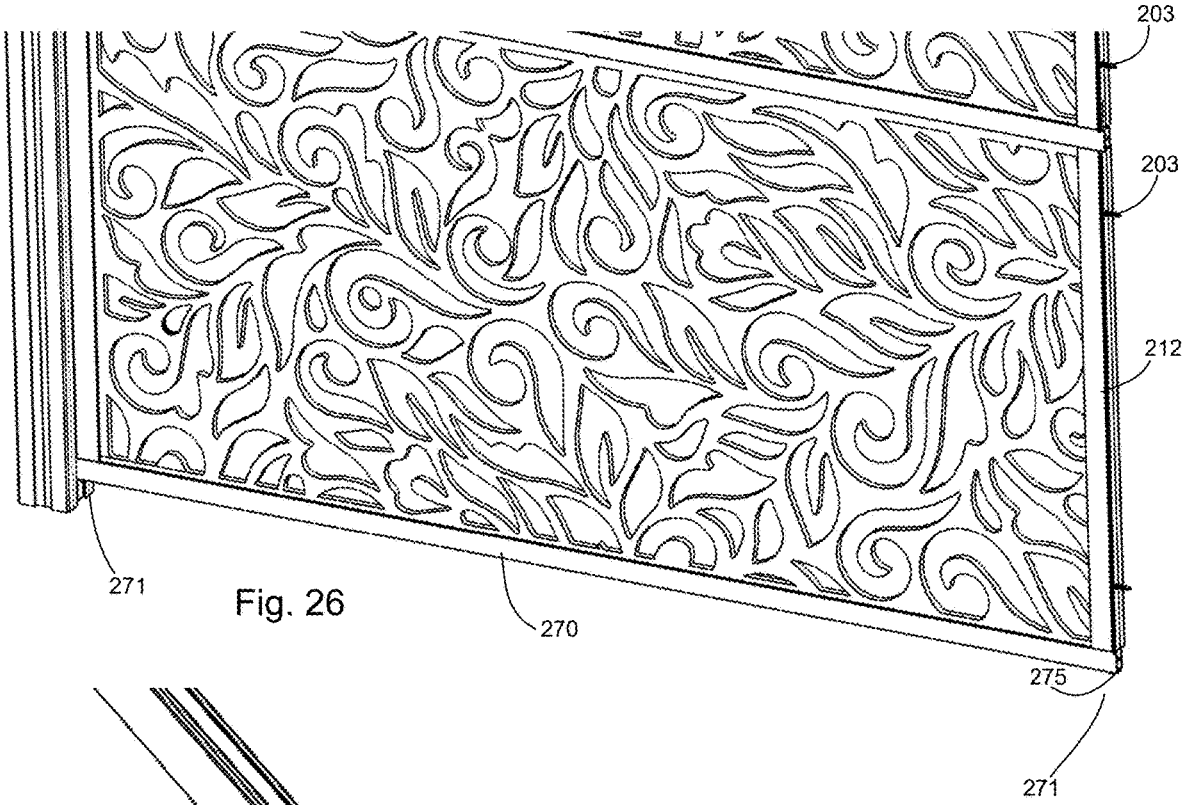
FIG. 26 is a partial view of the fencing system of FIG. 16, showing the lower member and one of the panels.
Figure 27:
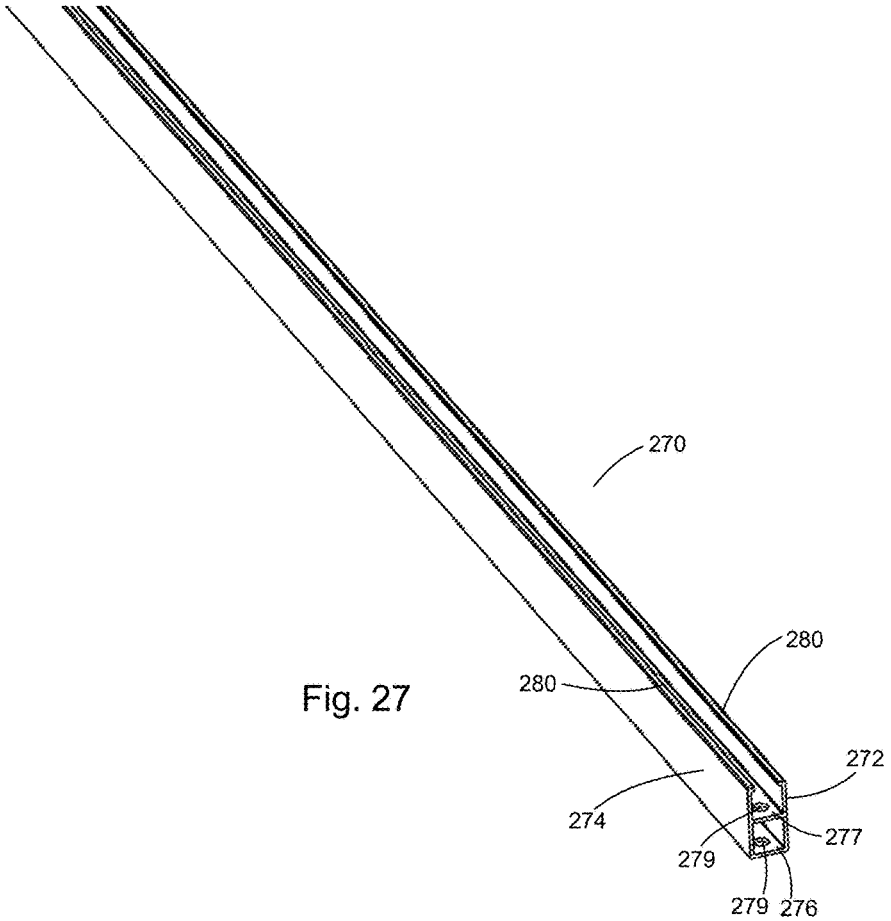
FIG. 27 is a partial view of the lower member of FIG. 26.

Referring to FIGS. 26 to 27, the fencing system 200 may also comprise elongated lower members 270 that are similar in configuration to lower members 170 of the previous embodiment. In particular, the lower members 270 comprise lower member first and second wings 272, 274, with lower member central portion 276 extending between the lower member first and second wings 272, 274 to form a generally C-shaped cross-sectional profile. However, the lower member 270 further comprises a lower member divider 277 extending between the lower member first and second wings 272, 274 and arranged substantially parallel to the lower member central portion 276. Preferably, one or more lower member openings 279 are located on both the lower member central portion 276 and the lower member divider 277, proximate to longitudinal lower member ends 271. Still more preferably, the lower member openings 279 located on the lower member central portion 276 are vertically aligned with the lower member openings 279 located on the lower member divider 277. The lower member openings 279 are configured to accept lower member fasteners 275 therethrough. The lower member fasteners 275 may include screws, bolts, or any other suitable mechanical fasteners.

Preferably, inward-facing lower member protrusions 280 extend from the lower member first and second wings 272, 274. However, in this embodiment, the panel lower notches 182 present in the previous embodiment are preferably not present. The lower member protrusions 280 preferably simply grip panel first and second surfaces 254, 256 (instead of engaging notches on the panels 204).

The lower member fasteners 275 are configured to secure the lower member 270 to the track member 212. To facilitate this, the track member 212 may comprise fastener receiving portions 213 that are proximate to the attachment portion 234 at track member first and second ends 230, 232. The fastener receiving portion 213 may comprise a partially circular wall 215 that is configured to receive the lower member fasteners 275. The fastener receiving portions 213 may extend from the track member first and second ends 230, 232 for at least a portion of the height of the track member 212. The fastener receiving portions 213 located proximate to the track member second end 232 are preferably aligned with the lower member openings 279 to allow the lower member fasteners 275 to pass therethrough, thereby securing the lower member 270 to the track member 212.

Figure 28:
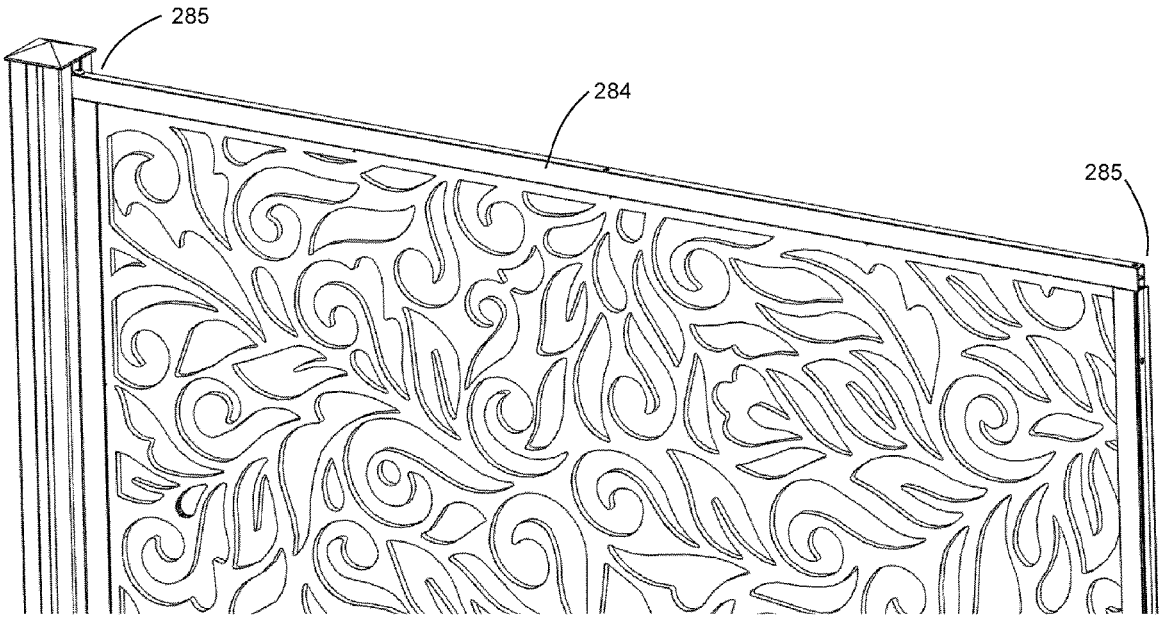
FIG. 28 is a partial view of the fencing system of FIG. 16, showing the upper member and one of the panels.
Figure 29:
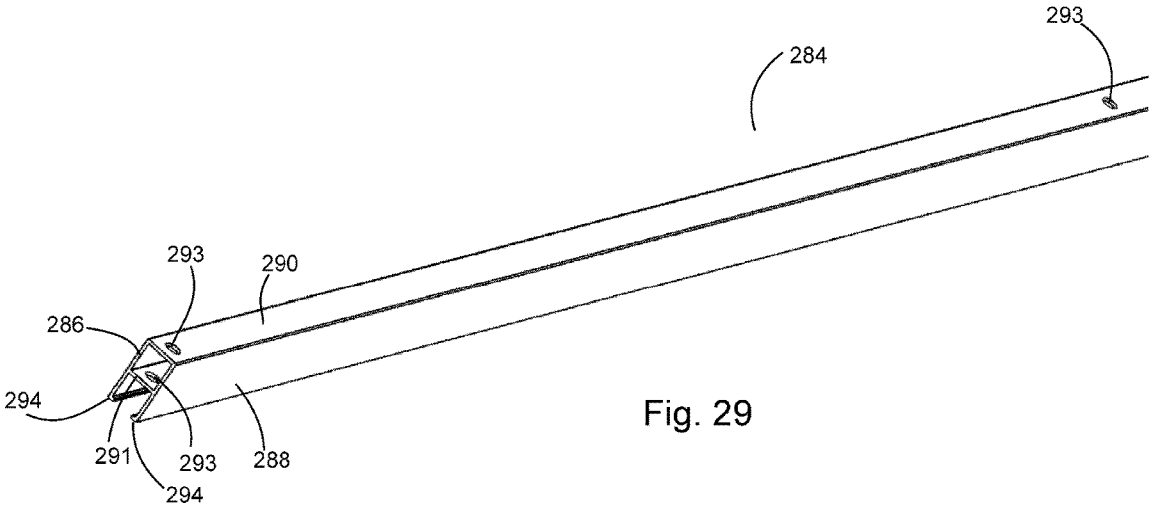
FIG. 29 is a partial view of the upper member of FIG. 16.

Referring to FIGS. 28 to 29, the fencing system 200 may also comprise elongated upper members 284 that are similar in configuration to upper members 184 of the previous embodiment. In particular, the upper members 284 comprise upper member first and second wings 286, 288, with upper member central portion 290 extending between the upper member first and second wings 286, 288 to form a generally C-shaped cross-sectional profile.

However, the upper member 284 further comprises an upper member divider 291 extending between the upper member first and second wings 286, 288 and arranged substantially parallel to the upper member central portion 290. Preferably, one or more upper member openings 293 are located on both the upper member central portion 290 and the upper member divider 291, proximate to longitudinal upper member ends 285. Still more preferably, the upper member openings 293 located on the upper member central portion 290 are vertically aligned with the upper member openings 293 located on the upper member divider 291. The upper member openings 293 are configured to accept upper member fasteners 289 therethrough. The upper member fasteners 289 may include screws, bolts, or any other suitable mechanical fasteners.

Preferably, inward-facing upper member protrusions 294 extend from the upper member first and second wings 286, 288. However, in this embodiment, the panel upper notches 196 present in the previous embodiment are preferably not present. The upper member protrusions 294 preferably simply grip panel first and second surfaces 254, 256 (instead of engaging notches on the panels 204).

The upper member fasteners 289 are configured to secure the upper member 284 to the track member 212, using the fastener receiving portions 213. The fastener receiving portions 213 located proximate to the track member first end 230 are preferably aligned with the upper member openings 293 to allow the upper member fasteners 289 to pass therethrough, thereby securing the upper member 284 to the track member 212.

Referring to FIGS. 26 to 29, in this embodiment, the upper and lower members 284, 270 preferably extend beyond the lateral panel edges 253 of the panels 204. This is because the lower member openings 279 are preferably aligned with the fastener receiving portions 213 located proximate to the track member second 232. Since the fastener receiving portions 213 are located beyond the panel edges 253, the lower member 270 must extend beyond the panel edges 253. Similarly, the upper member openings 293 are preferably aligned with the fastener receiving portions 213 located proximate to the track member first end 230. Since the fastener receiving portions 213 are located beyond the panel edges 253, the upper member 284 must extend beyond the panel edges 253.

FIGS. 30 to 40 depict a further embodiment of the invention. In this embodiment, the fencing system 300 also comprises substantially vertical posts 302 and one or more panels 304. The panels 304 may be made from wood.

Each of the posts 302 preferably comprises base 306 and generally upright member 308 extending from the base 306. The upright member 308 is substantially similar in configuration to the upright member 108, 208 of the previous embodiments. In particular, channels 324 are formed on surfaces 314 of the upright member 308, with the channels 324 being defined, at least in part, by planar section 316 and two angled sections 318. In this embodiment, the planar section 316 comprises one or more planar section openings 317 located at one or more locations along a height of the channels 324. The planar section openings 317 are configured to accept post fasteners 303 therethrough.

Figure 30:
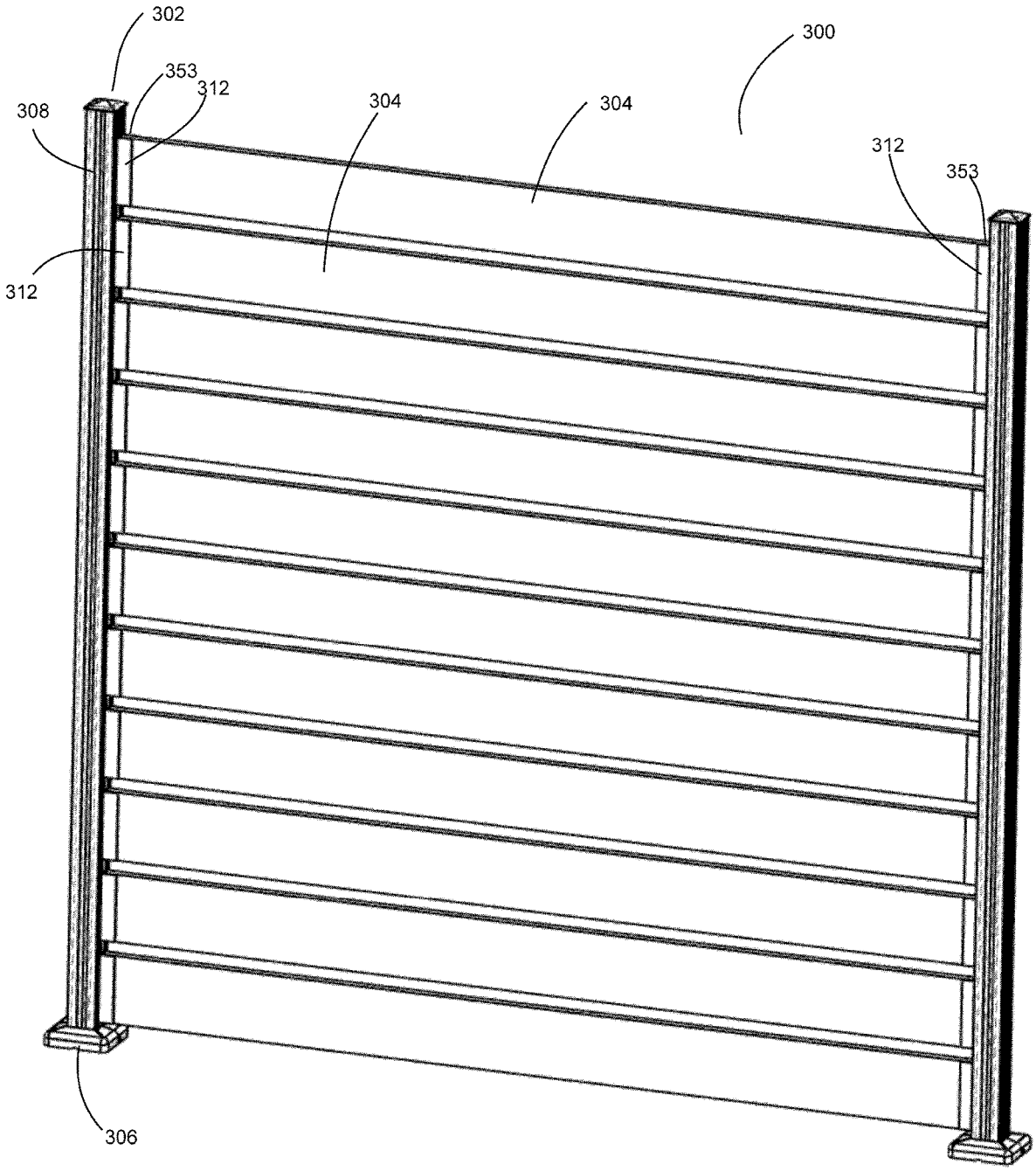
FIG. 30 shows the fencing system in accordance with a third embodiment of the invention.
Figure 31:
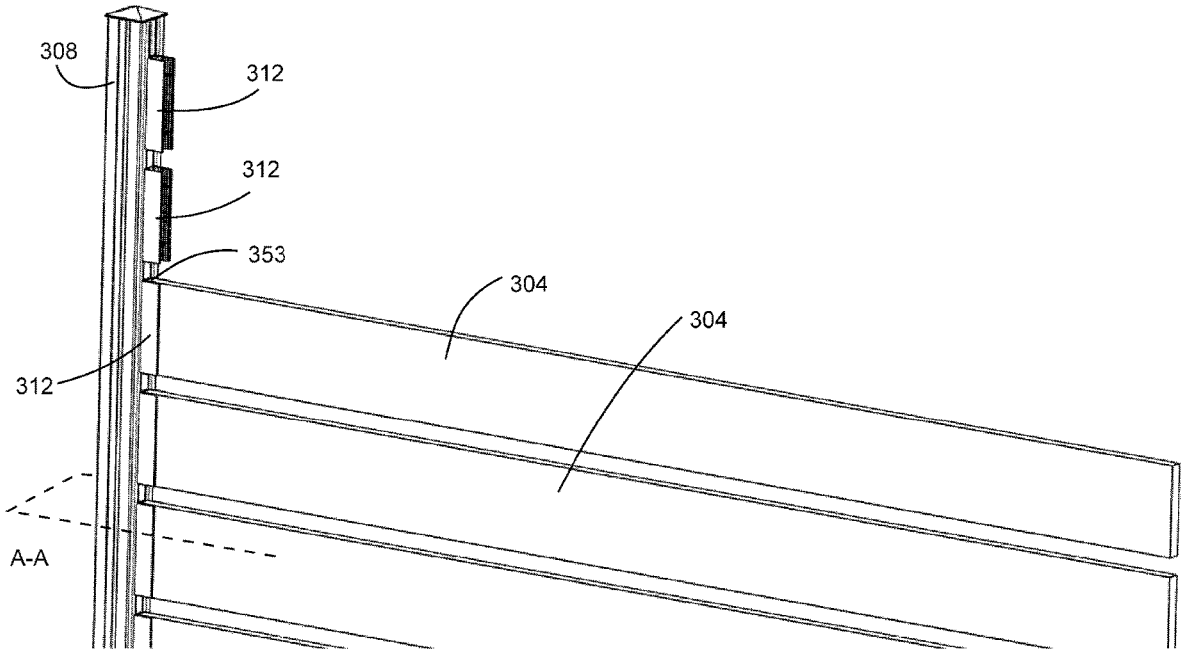
FIG. 31 is a partial view of the fencing system of FIG. 30, with two of the panels removed.
Figure 32:
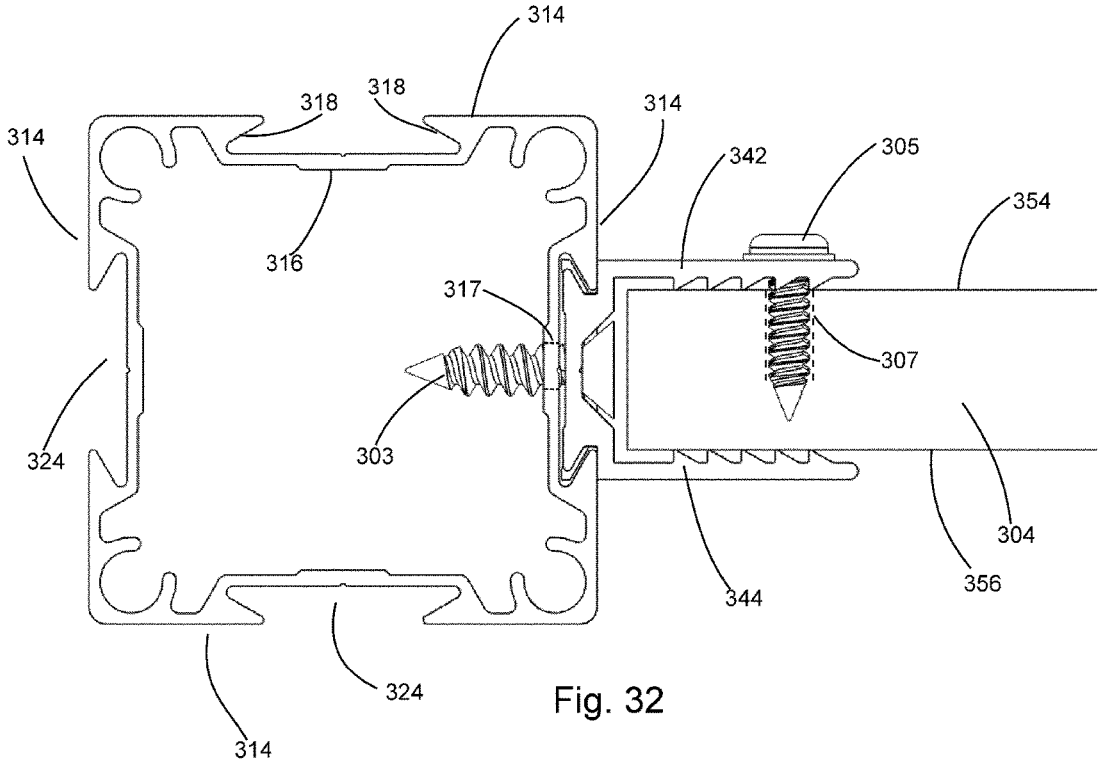
FIG. 32 is a partial sectional view, taken along plane A-A of FIG. 31.

Referring to FIGS. 30 to 32, the fencing system 300 comprises a plurality of track members 312. The track members 312 may be arranged along the posts 302 such that they are spaced apart from each other (as shown in FIG. 30). The track members 312 comprise attachment portion 334 and receiving portion 336. The attachment portion 334 comprises attachment surface 338 and two angled surfaces 340 extending from the attachment surface 338. The attachment surface 338 and the angled surfaces 340 are configured to engage within one of the channels 324. The attachment surface 338 comprises one or more attachment surface openings 339 that may be aligned with the planar section openings 317. The attachment surface openings 339 are also configured to accept the post fasteners 303 therethrough and allow the track member 312 to be secured to the planar section 316.

Figure 33:
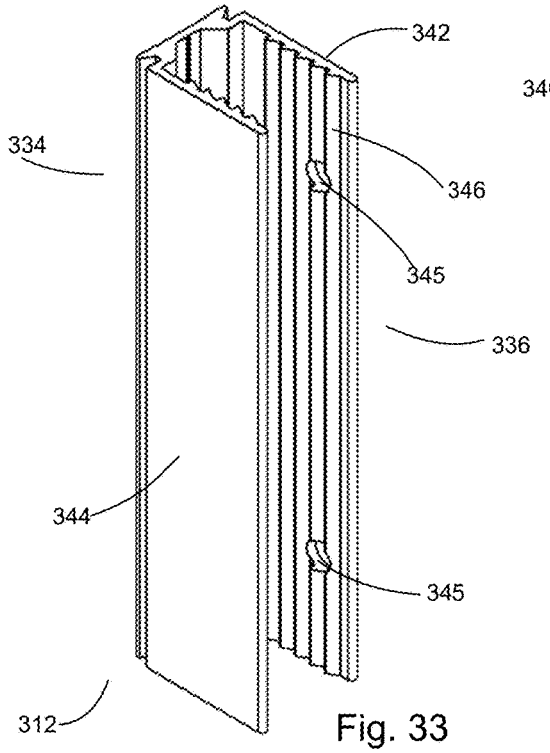
FIG. 33 is a perspective view of the track member of the fencing system of FIG. 30.
Figure 34:
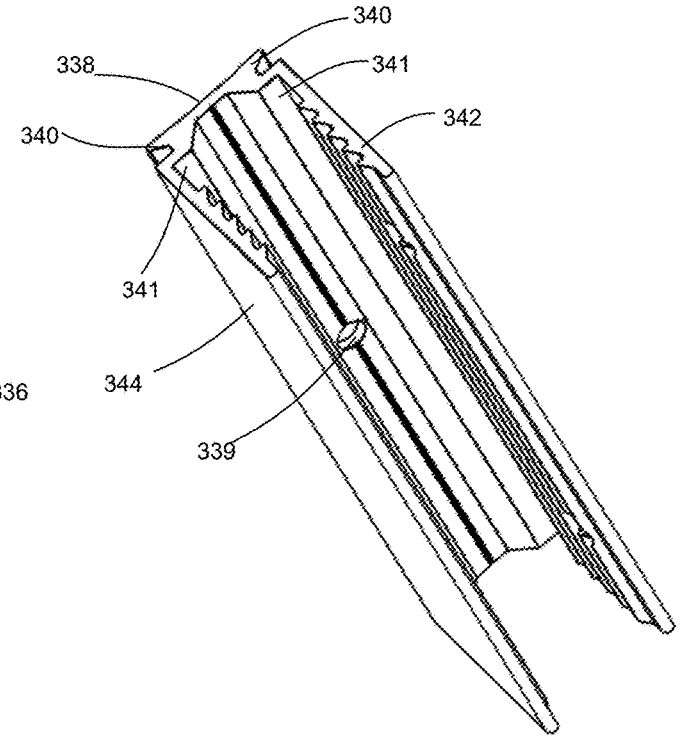
FIG. 34 is another perspective view of the track member of FIG. 33.
Figure 35:
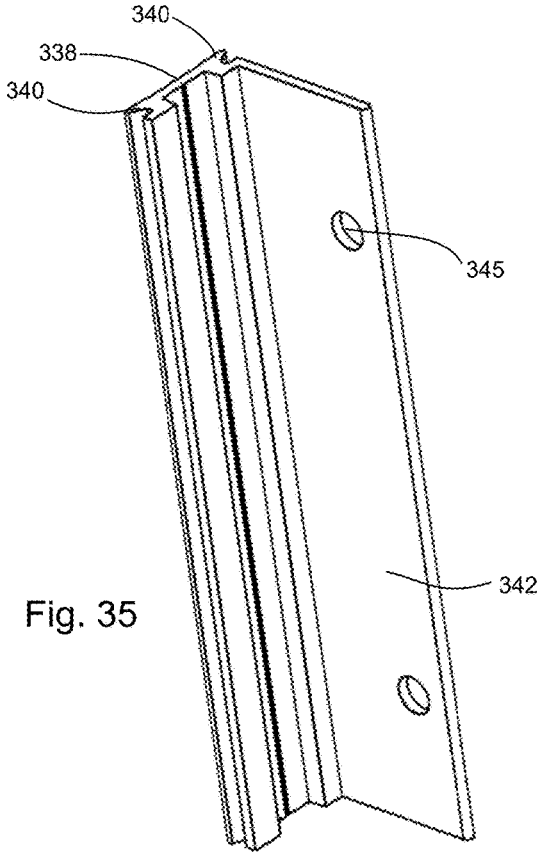
FIG. 35 shows another embodiment of the track member of FIG. 33.
Figure 36:
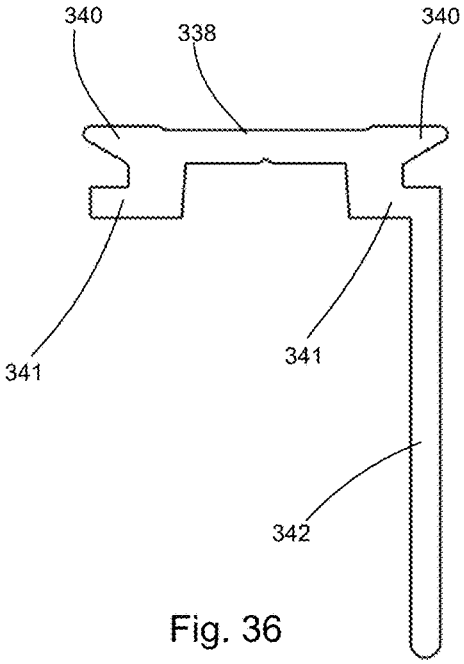
FIG. 36 is a top view of the track member of FIG. 35.

The receiving portion 336 comprises first and second wings 342, 344 extending from the attachment portion 334. Referring to FIGS. 33 and 34, the receiving portion 336 further comprises connector surfaces 341 extending between the angled surfaces 340 and either the first and second wings 342, 344. Preferably, one or more inward-facing protrusions 346 extend towards each other from each of the first and second wings 342, 344. The protrusions 346 preferably grip panel first and second surfaces 354, 356.

The receiving portion 336 is configured to engage with the panel 304. One or both of the first and second wings 342, 344 comprise one or more wing openings 345 that are configured to receive panel fasteners 305 therethrough. The panel fasteners 305 may include screws, bolts, or any other suitable mechanical fasteners. The wing openings 345 are preferably aligned with panel openings 307 located on either the panel first surface 354 and/or the panel second surface 356. The panel openings 307 are also configured to receive the panel fasteners 305 therethrough. The panel fasteners 305 may be used to secure the panels 304 to the track member 312. Preferably, as shown in FIG. 30, each of the track members 312 engages with one of the panels 304.

Unlike in the previous embodiments, the support members 158, 258, the lower members 170, 270, and the upper members 184, 284 are not needed in this embodiment.

The installation of the fencing system 300 will now be described. As with the fencing system 100, two of the posts 302 may first be attached to the ground 10 via the bases 306. Next, one or more of the track members 328 are inserted into one of the channels 324 of the upright member 308 of each of the posts 302. The channels 324 in which the upright members 308 are installed should be on the surfaces 314 that face each other. The track members 328 are then secured in place along the channels 324 by inserting the post fastener 303 through the attachment surface openings 339 and the planar section openings 317.

The panels 304 can then be attached to the track members 312. As described above, preferably, each of the track members 312 is attached to one of the panels 304. The panels 304 are attached to the track members 312 by inserting each of the lateral panel edges 353 in between the first and second wings 342, 344. Preferably, the distance between the first and second wings 342, 344 is similar (or slightly less) than the thickness of the panels 304. This will allow the panels 304 to snugly fit between the first and second wings 342, 344. The panels 304 can then be secured to the track members 312 by inserting the panel fasteners 305 through the wing openings 345 and the panel openings 307.

FIGS. 35 to 38 depict further embodiments of the track member 312. In the embodiment shown in FIGS. 35 and 36, the track member 312 comprises attachment portion 334 and receiving portion 336. The receiving portion 336 further comprises connector surfaces 341; however, only the first wing 342 is present (i.e. the second wing 344 is omitted). The wing openings 345 are located on the first wing 342. Therefore, the panel 304 is attached to the track member 312 by securing the first wing 342 to the panel first surface 354 using the panel fasteners 305 (by inserting the panel fasteners 305 through the wing openings 345 and the panel openings 307.

Figure 37:
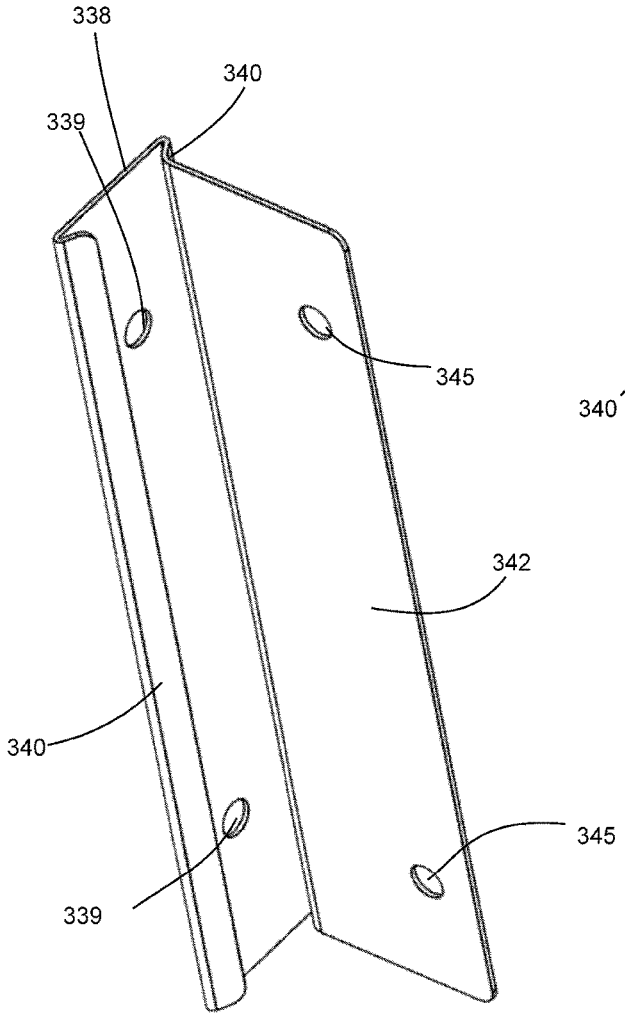
FIG. 37 shows another embodiment of the track member of FIG. 33.
Figure 38:
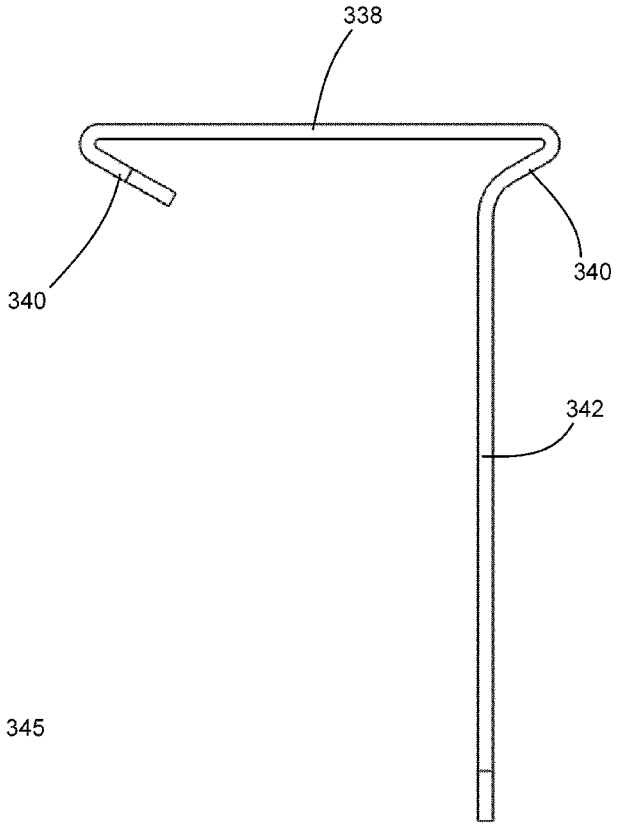
FIG. 38 is a top view of the track member of FIG. 37.

FIGS. 37 and 38 show another embodiment of the track member 312. In this embodiment, the track member 312 may be constructed from a single sheet of material (such as metal). In this embodiment, the track member 312 also comprises attachment portion 334 and receiving portion 336. The attachment portion 334 comprises planar section 316 and two angled sections 318 extending from the planar section 316. The receiving portion 336 comprises first wing 342 extending from one of the angled sections 318. The first one of the angled sections 318, the planar section 316, the second one of the angled sections 318, and the first wing 342 may be formed from a continuous sheet of material by bending at appropriate locations to form the structure shown in FIG. 37.

Wing openings 345 are located on the first wing 342. The panel 304 is attached to the track member 312 by securing the first wing 342 to the panel first surface 354 using the panel fasteners 305 (by inserting the panel fasteners 305 through the wing openings 345 and the panel openings 307.

Figure 39:
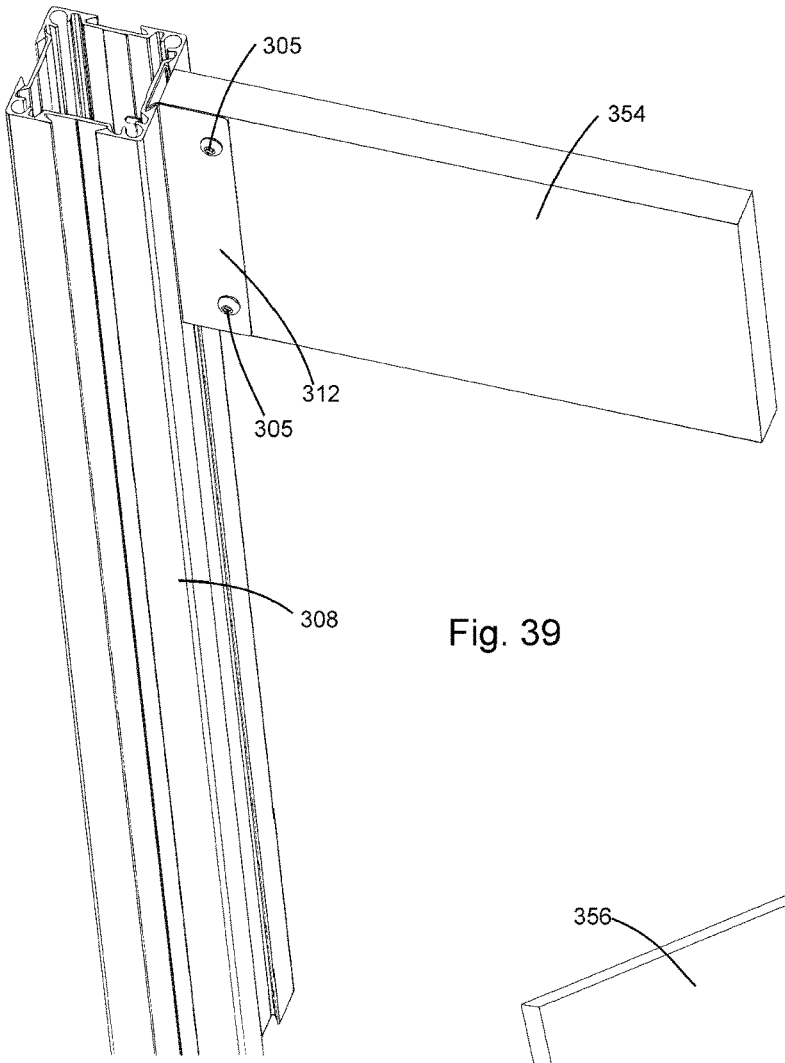
FIG. 39 is a partial rear perspective view of the fencing system with the track member of FIG. 37.
Figure 40:
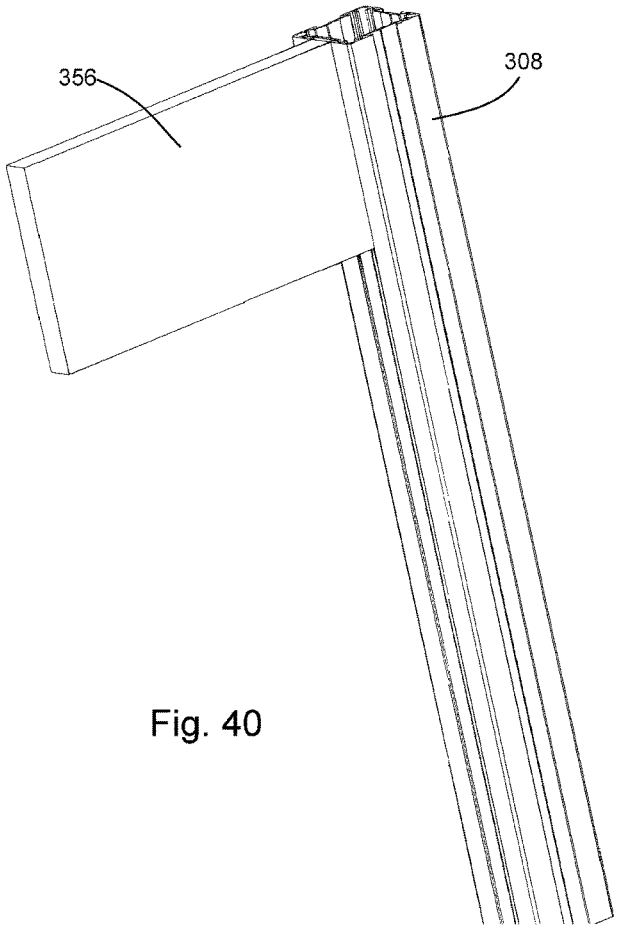
FIG. 40 is a partial front perspective view of the fencing system with the track member of FIG. 37.

The embodiments shown in FIGS. 35 to 38 omit the second wing 344 from the track member 312. Referring to FIGS. 39 to 40, when the track members 312 are installed to the posts 302 and the panels 304 are installed on the track members 312, the fencing system 300, when viewed towards the panel second surface 356, will show very little, if any, of the track members 312. This will produce a cleaner look for the fencing system 300 as it would appear, when viewed towards the panel second surface 356, that the panels 304 are directly attached to the posts 302.

It will be appreciated by those skilled in the art that the preferred embodiments have been described in some detail but that certain modifications may be practiced without departing from the principles of the invention.

The invention claimed is:

1. A modular fencing system comprising:

two or more substantially vertical posts, wherein each of the posts comprises:

a base;

an upright member extending from the base, the upright member comprising a plurality of surfaces, at least one of the surfaces defining a vertical channel;

one or more panels, each of the one or more panels comprising first and second surfaces, wherein each of the first and second surfaces comprise a notch extending vertically thereon;

one or more track members, each of the track members comprising:

an attachment portion configured to engage within the channel; and a receiving portion configured to engage with one or more of the panels, wherein the receiving portion comprises:

first and second wings extending parallel to each other; and elongated protrusions extending inwardly from each of the first and second wings, wherein each of the protrusions are adapted to engage with one of the notches.

2. The modular fencing system of claim 1, wherein the at least one of the surfaces comprises:

a planar section; and two angled sections extending from the planar section;

wherein the planar section and the two angled sections define, at least in part, the channel.

3. The modular fencing system of claim 2, wherein the attachment portion comprises:

an attachment surface; and two angled surfaces extending from the attachment surface;

wherein the attachment surface and the two angled surfaces are configured to engage within the channel.

4. The modular fencing system of claim 3, wherein the planar section comprises one or more planar section openings, and the attachment surface comprises one or more attachment surface openings, wherein the planar section openings are configured to receive post fasteners therethrough for securing the track member to the upright member.

5. The modular fencing system of claim 1, wherein each of the first and second wings comprise one or more wing openings, and the panel comprises one or more panel openings, wherein the wing openings and the panel openings are configured to receive panel fasteners therethrough for securing the wing to the panel.

6. The modular fencing system of claim 5, wherein each of the track members engages with one of the panels.

7. The modular fencing system of claim 1, wherein the one or more track members comprise a plurality of track members arranged on top of each other in an end-to-end configuration.

8. The modular fencing system of claim 1, wherein the one or more panels comprise at least two panels.

9. The modular fencing system of claim 8, wherein the at least two panels are arranged vertically.

10. The modular fencing system of claim 9, further comprising one or more support members, wherein one of the one or more support members is adapted to engage with a lower end of a first one of the one or more panels and with an upper end of a second one of the one or more panels.

11. The modular fencing system of claim 10, wherein at least one of the support members comprises:

a support member first wing;

a support member second wing; and a support member divider extending between the support first wing and the support member second wing;

wherein the support member first wing and the support member second wing engages with the lower end of the first one of the one or more panels and with the upper end of the second one of the one or more panels.

* * * * *